US010450853B2

(12) United States Patent
Parfitt et al.

(10) Patent No.: US 10,450,853 B2
(45) Date of Patent: Oct. 22, 2019

(54) DOWN HOLE SURVEYING

(71) Applicant: REFLEX INSTRUMENTS ASIA PACIFIC PTY LTD, Balcatta, Western Australia (AU)

(72) Inventors: Richard Parfitt, Lewes (GB); Guru Jabbal, Tapping (AU); Kai Ott, Amsterdam (NL)

(73) Assignee: REFLEX INSTRUMENTS ASIA PACIFIC PTY LTD, Balcatta Western Australia (AU)

( * ) Notice: Subject to any disclaimer, the term of this patent is extended or adjusted under 35 U.S.C. 154(b) by 226 days.

(21) Appl. No.: 15/520,461

(22) PCT Filed: Oct. 23, 2015

(86) PCT No.: PCT/AU2015/000634
§ 371 (c)(1),
(2) Date: Apr. 20, 2017

(87) PCT Pub. No.: WO2016/061616
PCT Pub. Date: Apr. 28, 2016

(65) Prior Publication Data

US 2017/0306747 A1 Oct. 26, 2017

(30) Foreign Application Priority Data

Oct. 23, 2014 (AU) ..... 2014904245

(51) Int. Cl.
*E21B 47/01* (2012.01)
*E21B 41/00* (2006.01)
(Continued)

(52) U.S. Cl.
CPC ..... *E21B 47/011* (2013.01); *E21B 41/00* (2013.01); *E21B 47/022* (2013.01); *E21B 23/00* (2013.01)

(58) Field of Classification Search
None
See application file for complete search history.

(56) References Cited

U.S. PATENT DOCUMENTS 6,529,834 B1 3/2003 Estes et al.
2002/0046845 A1* 4/2002 Rayssiguier ..... E21B 23/006 166/375

(Continued)

FOREIGN PATENT DOCUMENTS

WO WO-2004013573 A2 2/2004
WO WO-2010057055 A2 5/2010
WO WO-2011/146988 A1 12/2011

OTHER PUBLICATIONS

International Search Report PCT/ISA/210 for International Application No. PCT/AU2015/000634 dated Dec. 21, 2015.

(Continued)

*Primary Examiner* — Jill E Culler
(74) *Attorney, Agent, or Firm* — Stites & Harbison, PLLC; Terry L. Wright

(57) ABSTRACT

In one aspect, there is disclosed an apparatus for indexing a device about an indexing axis, the apparatus comprising an indexing drive mechanism comprising a drive portion configured in driving engagement with a driven member for indexing the device about the indexing axis. The driven member is arranged in operable association with an assembly comprising at least one resilient element arranged so as to be capable of transitioning to/from a state of bias such that exposure of the device to any undesirable physical forces is reduced to at least some extent.

21 Claims, 8 Drawing Sheets

(51) Int. Cl.
*E21B 47/022* (2012.01)
*E21B 23/00* (2006.01)

(56) References Cited

U.S. PATENT DOCUMENTS

| | | | | |
|---|---|---|---|---|
| 2009/0126936 | A1* | 5/2009 | Begley | E21B 21/103 166/319 |
| 2012/0095685 | A1 | 4/2012 | Ekseth et al. | |
| 2013/0118731 | A1* | 5/2013 | Parfitt | E21B 47/022 74/813 R |

OTHER PUBLICATIONS

Written Opinion of the International Searching Authority PCT/ISA/237 for International Application No. PCT/AU2015/000634 dated Dec. 21, 2015.
International Preliminary Report on Patentability PCT/IPEA/416 for International Application No. PCT/AU2015/000634 dated Oct. 31, 2016.
Extended European Search Report for Corresponding European Application No. 15853469.3, dated Jun. 4, 2018.

* cited by examiner

DOWN HOLE SURVEYING

CROSS-REFERENCE TO RELATED APPLICATIONS

This application is a national phase under 35 U.S.C. § 371 of PCT International Application No. PCT/AU2015/000634 which has an International filing date of Oct. 23, 2015, which claims priority to Australian Application No. 2014904245, filed Oct. 23, 2014, the entire contents of each of which are hereby incorporated by reference.

TECHNICAL FIELD

Aspects of the technology described herein relate broadly to the field of down hole surveying.

The present application claims priority to Australian provisional patent application No 2014904245, the content of which is incorporated herein.

BACKGROUND ART

The following discussion of the background art is intended to facilitate an understanding of the present invention only. The discussion is not an acknowledgement or admission that any of the material referred to is or was part of the common general knowledge as at the priority date of the application.

During a borehole drilling operation there is a need to survey the path of the borehole to determine if its course is being maintained within acceptable limits. Surveying a borehole is usually accomplished using a surveying tool which is moved along the borehole to obtain the information required, or at least data from which the required information can be determined. Information relating to the path of a borehole can typically include inclination, azimuth and depth.

Surveying tools typically contain sensor devices for measuring the direction and magnitude of the local gravitational field and also the direction and magnitude of the rate of rotation of the Earth. These measurements correspond to the orientation of the surveying tool in the borehole. The position, inclination and/or azimuth can be calculated from these measurements.

The sensor devices can comprise accelerometers for measuring the direction and magnitude of the local gravitational field, and gyroscopes for measuring direction and magnitude of the rate of rotation of the Earth, from which azimuth can be calculated.

Commercially available gyroscopes contain systematic errors which can seriously affect the accuracy of measurement. Such errors can be removed by indexing the gyroscope.

In order to index sensor devices between various indexing positions, there is a need for an indexing mechanism aboard the surveying tool.

The need to index and orient the sensor devices can introduce cost and complexity to the surveying tool, and can be particularly problematic where a survey tool/instrument of compact construction is required. Furthermore, known indexing arrangements usually require direct mechanical drive using a stepper motor or servo motor with precision position encoding resulting in additional cost and technical complexity.

In some instances, the use of conventional motor drives and related mechanical configurations used for indexing purposes can reduce the precision of information recorded during a survey of a borehole. In this regard, induced vibrational and/or shock forces occurring during measurement and/or indexing can compromise the data recorded by sensors included with the surveying tool (especially if using a servo control loop for positioning the sensors).

It is against this background that the present invention has been developed.

SUMMARY OF INVENTION

According to a first principal aspect, there is provided an apparatus comprising:

a first body, and a second body, the first body and the second body configured operable so that either may be moveable relative to the other in a manner in which exposure of at least a portion of the first body or a portion of the second body to any undesirable physical forces is substantially reduced.

Embodiments of the apparatus of the first principal aspect, and those which follow, may be configured for use in down hole surveying operations for indexing a sensor carrying device about an indexing axis between, for example, two index positions. With specific regard to a borehole surveying operation, the skilled reader will understand that the indexing of sensors, such as for example a gyroscope, is necessary in order to reduce or avoid inherent measurement errors. However, data measured by the sensors can be compromised by unwanted physical forces inherent within the system.

The sensor carried by the device may be of any appropriate type; for example, the sensor may comprise one or more of the following: accelerometers, gyroscopes, physical switches, magnetometers, vibration sensors, inclinometers, inductive RPM sensors, flow sensors and pressure sensors, or any suitable combination. The latter examples are not to be taken as being an exhaustive list. The skilled reader would readily appreciate the appropriate scope of sensors which could find utility in application with embodiments of the apparatus/method/system of the principal aspects described herein.

Undesirable physical forces may include system and/or external/shock forces considered adverse to the normal operation of the apparatus and/or sensor carried by or associated with the apparatus. Such forces often serve to compromise the integrity of data measured and/or recorded by the sensor devices. Furthermore, undesirable forces may also include vibration forces which may include induced physical movement/forces resulting from prime movers such as, for example, electric motors. While the latter is not exhaustive as to what physical forces may potentially compromise the measurement operation of a sensor employed for down hole surveying operations, the skilled reader will appreciate the scope of forces (and their origin) which have the potential to compromise data measurement in such environments.

Vibration forces may include induced physical movement/forces resulting from prime movers such as, for example, electric motors. As one example, a servo motor or stepper motor is usually driven by a chopped drive current to allow accurate control of its speed and position. In some instances, this chopped current can cause small vibrations of the motor shaft even when stationary. Thus, if a motor is directly coupled to a device carrying a sensor, and drives the device/sensor to an index position, when held at that position the residual vibrations of the shaft can be transferred to the sensor causing unwanted sensor noise. Accordingly, embodiments of the apparatus described herein, may serve to reduce and/or dampen such vibration forces from adversely affecting the device (and therefore any sensor carried thereby) during operation.

As a further example, in some instances, vibration forces which can compromise gyroscope sensors can originate from the gyroscope itself (ie. when the gyroscope is spinning). The unbalanced state of the gyroscope's rotor can create a vibration when rotating at multiples of the gyroscope spin frequency. This vibration can be transmitted and, in some instances, reflected by the surrounding mechanics (ie. the indexing apparatus). The unequal transmission and reflection of this vibration in the available indexing positions has the potential to compromise the gyroscope measurement data. Accordingly, in some instances, a significant problem is that the vibration created/present during measurement. In some scenarios, such vibrational components can be relatively more significant than those occurring as a result of indexing the gyroscope between possible or available indexing positions.

Shock forces may include various external forces applied to the apparatus and related components during its movement into, within, and/or out of the borehole for measurement purposes. Furthermore, shock forces may include contact or impact occurring between working components of the apparatus. For example, in some arrangements, when positioning a sensor accurately at or near one of, for example, two indexing positions, an indexing end stop (such as a mechanical stop provided, for example, in the form of a dowel pin) is often used. The resulting impact of the sensor (or the component which carries the sensor) contacting the end stop can result in shock forces that have the potential to cause the sensor's bias to change. In some instances, shock forces may be less of a threat to the operation of the device during indexing so long as the motion of the drive motor is smooth, which can be the case in practice.

With the above borne in mind, embodiments of the apparatus of the principal aspects described herein, may serve to provide:

- an apparatus for indexing a sensor arrangement (including, for example, gyroscopes and/or accelerometers) for offering improved accuracy at reduced cost as compared with conventional devices employing, for example, direct drive technology incorporating servo motor and precision encoders, which devices can induce vibration at motor pulse width modulation (PWM) frequency into an attached gyroscope (since the motor is needed to be operated so as to hold the gyroscope at an index position);
- sufficient holding force against the limit positions can be maintained with the motor when not powered;
- an ability to dampen shock, vibration, and/or impact when approaching the index/limit points to avoid torque impulse; or
- an ability to drive one or more sensor devices to an intermediate or park position and providing torque impulse absorption capability when the sensor is not measuring.

Embodiments of the apparatus of the first principal aspect may be exemplified in at least two implementations: a first implementation in which the first body, for example, is arranged having a support portion configured for carrying a sensor. In this arrangement, the second body is arranged operable so as to index the first body about the indexing axis. In this manner, the second body is arranged stationary relative to the indexing axis and carries a drive means arranged in driving engagement with the first body so as to index the first body about the indexing axis. The first body is configured such that driving of the first body by the drive means is in a manner in which exposure of the support portion to any undesirable physical forces is substantially reduced.

In one embodiment, the first body is configured having a driven portion which is drivingly engaged with the drive means carried by the second body.

In another embodiment, the driven portion and the support portion of the first body are associated with one another in a manner in which exposure of the support portion to any undesirable physical forces is reduced. In one arrangement, the association between the support portion and the driven portion of the first body is resilient in nature. In one particular embodiment, the resilient association may be provided in the form of an assembly comprising one or more resilient coupling elements coupling the driven portion and the support portion together.

Embodiments of the apparatus which exemplify a second implementation of operation are also possible. In one such arrangement, similar to the first implementation described above, the second body is arranged to carry the sensor and the drive means. Further, the drive means is configured in driving engagement with a driven portion of the first body. However, the second body is provided with freedom to rotate about the indexing axis. In this arrangement, the first body comprises a portion thereof which is arranged so as to be substantially stationary relative to the indexing axis. In this arrangement, the stationary portion and the driven portion of the first body are associated with one another in a manner in which exposure of the second body (or a portion of the second body configured for supporting a sensor) to any undesirable physical forces is substantially reduced.

In one arrangement, the association between the stationary portion and the driven portion of the first body is resilient in nature. In one particular embodiment, the resilient association may be provided in the form of a coupling assembly comprising one or more resilient coupling elements coupling the driven portion and stationary portion of the first body together.

In one embodiment, the drive means is provided in the form of an indexing drive mechanism having a drive portion configured so that it can be placed in driving engagement with the driven portion of the first body.

Embodiments of the second to sixth principal aspects relate particularly to embodiments of the apparatus when configured in accordance with the first implementation. Embodiments of the seventh to eleventh principal aspects relate to embodiments of the apparatus when configured in accordance with the second implementation.

According to a second principal aspect of the present invention, there is provided an apparatus for indexing a device about an indexing axis, the device having a support portion for supporting a sensor, the apparatus comprising:

an indexing drive mechanism comprising a drive portion configured for indexing the device about the indexing axis, the device arranged in driving engagement with the drive portion, wherein the device is configured operable so as to be driveable in a manner in which exposure of the support portion to any undesirable physical forces is reduced to at least some extent.

According to a third principal aspect, there is provided an apparatus for indexing a device about an indexing axis, the device having a support portion for supporting a sensor, the apparatus comprising:

an indexing drive mechanism comprising a drive portion configured for indexing the device about the indexing axis, the device arranged in driving engagement with the drive portion, wherein the device is configured operable so as to be driveable to or towards a state in which exposure of the support portion to any undesirable physical forces is reduced to at least some extent.

Embodiments of the second to sixth principal aspects may incorporate any of the following features.

In one embodiment, the state in which exposure of the support portion to any undesirable physical forces is substantially reduced is a biased state.

The skilled reader will appreciate that the apparatus requires a physical input or force (a necessary and therefore desirable physical input or force) in order to cause indexing of the device about the indexing axis to or toward one or more index positions. As noted above, undesirable physical forces may include system and/or external forces considered adverse to the normal operation of the apparatus. Typically, such undesirable forces often serve to compromise the integrity of data measured and/or recorded by any sensor devices (such as for example a gyroscope) which might be carried by the support portion of the device. In this manner, and in accordance with one embodiment, for example, the bias state of the device is arranged operable for substantially isolating the support portion from undesirable physical forces during operation of any sensor carried thereby. In some arrangements, operation (eg. operation for the purposes of measuring data) of such a sensor generally occurs when the sensor is substantially stationary (ie. when the device is substantially stationary following indexing to a desired indexing position for measurement purposes).

The support portion of the device may be arranged to carry a sensor arrangement comprising one or more sensor devices. As noted above, the or each sensor device may be of any appropriate type; for example, the sensor device may comprise one or more of the following: accelerometers, gyroscopes (eg. microelectromechanical gyroscopes (MEMs)), physical switches, magnetometers, vibration sensors, inclinometers, inductive RPM sensors, flow sensors and pressure sensors, or any suitable combination. The latter examples are not to be taken as being an exhaustive list. The skilled reader would readily appreciate the appropriate scope of sensors which could find utility in application with embodiments of the apparatus and method/system of the principal aspects described herein.

In one embodiment, operation of the apparatus allows indexing of the device to or toward more than one index position.

In another embodiment, operation of the apparatus allows indexing of the device to or toward either of two indexing positions: a first index position and a second index position. In such embodiments, the first index position corresponds substantially with a first limit position and the second index position corresponds substantially with a second limit position.

In some arrangements, the apparatus allows the device to be selectively rotated about the indexing axis to or toward the first or second limit positions consecutively in a substantially continuous manner. In one embodiment, the latter may occur over a finite period of time, such as for example, when down hole in a bore hole (ie. for the purposes of surveying the bore hole).

In one embodiment, the apparatus includes a body provided in the form of a chassis which is configured to support or carry the indexing drive mechanism having a drive assembly (which could, for example, include a motor unit, gearbox arrangement, and/or encoder assembly).

In some embodiments of the apparatus, the body is arranged so as to be fixed or held rigid relative to the indexing axis so that the device rotates about the indexing axis by way of the drive portion. In some embodiments, such fixture (or rigid support) will often be provided by way of rigid connection with a down hole surveying instrument or a down hole surveying tool which carries the apparatus.

In embodiments of the second implementation (discussed further below), the body may be configured so as to carry a sensor arrangement and rotate about the indexing axis.

In another embodiment, the body carries or supports the indexing drive mechanism.

In another embodiment, the indexing drive mechanism is configured for selectively indexing the device about the indexing axis.

In a further embodiment, the body is a component of the indexing drive mechanism.

In another embodiment, the body is configured in a manner affording sufficient stiffness and/or rigidity so as to, at least in part, absorb any vibrational energy which might be caused by one or more sensors carried by the support portion of the device during operation.

In one embodiment, the body comprises a longitudinal axis which is arranged substantially concentric with the indexing axis.

In one embodiment, the device is arranged relative a region of the body so that it may rotate thereabout by drive provided by the drive portion of the indexing drive mechanism. The indexing drive mechanism may be arranged so as to be supported by the body in an off-axis manner relative to the indexing axis.

In one embodiment, the device comprises a driven portion which is arranged relative a region of the body so that it may rotate thereabout by drive provided by the drive portion. In this manner, the driven portion is configured to rotate about the indexing axis.

In one embodiment, the driven portion and support portion of the device are arranged in operation association with one another.

In one embodiment, the association between the driven portion and the support portion is provided in the form of a coupling assembly. In one arrangement, the coupling assembly comprises one or more coupling elements. The or each coupling element may be provided in such a manner so as to afford a degree of resilience to the association between the driven portion and the support portion.

In some embodiments, the association between the driven portion and the support portion is arranged so that the support portion is resiliently responsive to the driven portion so that the support portion follows movement of the driven portion. In this manner, the association between the support portion of the device and the driven portion is arranged operable so as to reduce potential exposure of the support portion to any undesirable physical forces (as discussed above) during operation of the apparatus, which operation may include, for example, when the support portion is positioned at or near any one of the one or more index positions, and/or during indexing of the device about the indexing axis to or toward any one of the one or more index positions. Put another way, the association between the driven portion and the support portion may be arranged operable so as to substantially absorb or reduce the effects of any undesirable physical forces when the apparatus is operable.

The association between the driven portion and the support portion may be arranged so that the support portion is substantially isolated from the undesirable physical forces when the apparatus is operable.

In some embodiments, the sensor carried by the support portion is held in position for a period of time so that it can remain substantially stationary at one of the one or more index positions during measurement operations so that substantially no motor control or other vibrational disturbance results which might have potential to compromise measurement by the sensor.

In another embodiment, the association between the driven portion and the support portion may be provided having an initial alignment relative one another. In this manner, the relative alignment between the support portion and the driven portion is arranged so as to define a desired or predetermined state of relative alignment between both components. In some arrangements, the association between the driven portion and the support portion is configured so that the relative alignment is pursued when the driven portion is moved by drive provided by the drive portion. In this manner, the association between the driven portion and the support portion is such that the response of the support portion, when caused to follow the driven portion, is to seek to maintain the initial state of relative alignment.

In another embodiment, the apparatus is configured so that the desired or predetermined state of relative alignment is arranged so to be intermediate the first index position and the second index position.

In a further embodiment, the apparatus is configured such that the desired or predetermined state of relative alignment between the driven portion and the support portion is substantially biased toward one of the first index position or the second index position.

In one embodiment, the coupling assembly is configured so as to provide a resilient association between the driven portion and the support portion. In this manner, the resilient association between the support portion and the driven portion is arranged operable for substantially isolating the device from undesirable physical forces during operation of a sensor carried by the device so that exposure of the support portion to any undesirable physical forces is substantially reduced.

In one arrangement, the coupling assembly is arranged so as to associate the driven portion with the support portion so that the support portion is responsive to movement of the driven portion.

In another embodiment, the coupling assembly is arranged so that movement of the support portion of the device is substantially biased in the direction of movement of the driven portion. In this manner, the coupling assembly is arranged so that the support portion is biased or urged toward either the first or second limit position in response to selective movement of the driven portion when subject to drive provided by the drive portion. Thus, movement of the driven portion provokes a corresponding movement of the support portion of the device in the same direction.

The coupling assembly may comprise one or more biasing elements. The or each coupling element may be arranged so as to associate the driven portion with the support portion. In one embodiment, the or each coupling element is arranged so as to connect the driven portion and the support portion together.

In one embodiment, one or more portions or regions of at least one of the or each coupling elements may be configured so as to be capable of transitioning to a state of bias for biasing the support portion in favour of the direction of movement of the driven portion.

In another embodiment, one or more portions or regions of at least one of the or each coupling elements may be configured so as to be co-operable for transitioning to a state of bias for biasing the support portion in favour of the direction of movement of the driven portion.

One or more of the or each coupling elements may be provided in a physical or geometrical form which affords a degree of resilience to the element as a whole. In this regard, for example, the material from which a coupling element is formed could be substantially inextensible, however, the form in which it is provided could be sufficient to allow the element to behave in a substantially resilient manner (eg. a coil spring).

One or more of the or each coupling elements may comprise a level of resilience allowing the or each coupling element to return to an original form on removal of an externally applied force, the application of which causes a modification of the coupling element to a modified form. In one embodiment, the modified form of a coupling element is one in which the coupling element is extended from its original shape/form. Thus, when so extended, the resilient nature of the coupling element seeks to revert the extended coupling element to its unmodified form, so resulting in a biasing force.

In one embodiment, the or each coupling element comprises a coil spring.

In another embodiment, the or each coupling element comprises a rubber element such as a rubber band or rubber sleeve.

In another embodiment, any resilient characteristic of the or each coupling element could be provided by way of the material from which the coupling element is made or formed from.

In one embodiment, the body or chassis is provided in the form of a substantially elongate member of finite length and uniform cross section. In one arrangement, for example, the body is tubular having a circular cross section and/or a hollowed region.

In another embodiment, one end of the body is configured for supporting the indexing drive mechanism.

In one embodiment, the body is arranged concentric with the indexing axis.

In another embodiment, the device is arranged substantially concentric with the indexing axis.

In one embodiment, the driven portion is arranged substantially concentric with the indexing axis.

In another embodiment, the support portion is arranged substantially concentric with the indexing axis.

The indexing axis, in one form for example, may be aligned substantially with the longitudinal axis of the body.

In one embodiment, the body comprises a tubular portion about which the support portion and driven portion are rotatably supported so that each are capable of rotating thereabout. In arrangements of this nature, the driven portion and/or the support portion are rotatably mounted to the tubular portion of the body by way of respective bearing means. For example, such bearing assemblies may comprise ball race bearing assemblies.

The or each coupling element may comprise a resilient coupling element.

In another embodiment, the coupling assembly comprises one or more resilient coupling elements.

In one embodiment, the device can be driven so that it can be parked in a position substantially between or intermediate two index or limit positions. In such instances, the resilient nature of the coupling assembly affords, at least in part, some protection to the support portion reducing exposure to external shocks applied to the down hole instrument or tool (that carrying the apparatus) during transit into or out of the borehole.

In a further embodiment, the coupling assembly comprises first and second resilient coupling elements.

In one arrangement, the first and second resilient coupling elements comprise opposite free ends. In such arrangements, one end of each of the first and second resilient coupling elements is attached to the driven portion, and the alternate end of each of the first and second resilient coupling elements is attached to the support portion.

In another embodiment, the ends of the first and second resilient coupling elements which connect to the driven portion are arranged adjacent one another, and the alternate ends of the first and second resilient coupling elements which connect to the support portion are arranged adjacent one another.

In one arrangement, where the body is provided in tubular form, and the body is substantially concentric with the indexing axis, the region of the driven portion at which the first and second resilient coupling elements connect with the driven portion is substantially opposite to the region of the support portion at which the alternate ends of the first and second resilient coupling elements connect thereto. In arrangements of this nature, it will be understood that the regions are substantially symmetrical about the indexing axis (or about 180 degrees apart).

In a further embodiment, the apparatus comprises a limit means arranged for confirming an indexed position of the device at either of the first or second limit positions. The limit means may take the form of a mechanical stop fixed relative to the body and against which a region of the device may be brought to bear to confirm registration in either of the first or second limit positions.

In one embodiment, the device is provided with two limit pins, each positioned and arranged so as to correspond with respective first or second limit positions. In such arrangements, registration of the device in the first index position requires sufficient rotation of the device so that one of the limit pins is brought to bare against the mechanical stop. Similarly, registration of the device in the second index position requires sufficient rotation of the device so that the alternate limit pin is brought to bare against the mechanical stop.

In one embodiment, the two limit pins are arranged on the support portion in the manner described above.

In one embodiment, the mechanical stop is provided in the form of an elongate element of finite length arranged so as to extend radially outward from the body (for example, when the body is provided in tubular form). The mechanical stop may comprise a finite length rod element or dowel pin.

In one embodiment, each of the limit pins may also comprise finite length rod like elements or dowel pins of appropriate length and form. In one arrangement, the limit pins are embedded in the device (or support portion).

In another embodiment, the first and second limit pins (corresponding to respective limit positions) are arranged so as to be substantially 180 degrees apart.

In one embodiment, the device is driven by the driven portion so as to bear against the mechanical stop so as to confirm registration in either of the first or second limit positions.

In one embodiment, the support portion is biased by the driven portion against the mechanical stop so as to confirm registration in either of the first or second limit positions In another embodiment, the apparatus is arranged so that the driven portion can continue to be driven once the region of the device is brought to bear against the mechanical stop in either the first or second limit position. In such arrangements, additional drive provided by the driven portion (causing additional rotation thereof) serves to confirm registration of the device (at a desired limit position) by establishing a holding force so as to hold the device against the stop due to the bias of the first or second resilient coupling elements (depending on which limit position is reached). This is due to the extension of the relevant resilient coupling element caused by the over rotation of the driven portion.

The support portion may be configured having a slot arranged operable with the mechanical stop so as to allow the device to rotate relative the tubular portion for indexing between the first and second limit positions, interference of the stop with a portion of the slot serving to confirm registration of the support portion in one of the first or second limit positions. In one arrangement, interference of the stop with a first portion of the slot confirms registration of the support portion in one of the first or second limit positions, and interference of the stop with a second portion of the slot confirms registration of the support portion in the other of the first or second limit positions.

In one embodiment, the limit pins are arranged and/or embedded at opposing regions of the slot.

In one embodiment, the slot is substantially linear and arranged substantially circumferentially about a region of the support portion.

In one embodiment, the holding force can be arranged to be applied for a predetermined period of time. Furthermore, the drive portion could be arranged so as to cease operation during the course of the predetermined period of time. For the case where the drive portion comprises or is operated by way of an electric motor, the electrical connections of the electric motor could be arranged to be intentionally short circuited so as to provide an electromechanical braking effect. In such arrangements, the device (or support portion) can be biased toward or against a desired limit position as a consequence of the driven portion being driven beyond the desired limit position (so extending the relevant resilient coupling element resulting in the biasing force) and the motor purposefully braked so that the motor draws minimal or reduced power; for example, the operation of the motor can be ceased until caused to be operational.

In a further embodiment, the first and second resilient coupling elements are attached to the driven portion and the support portion in such a way so that each first and second resilient coupling element is provided substantially symmetrical about the body relative one another. In this manner, the first and second resilient coupling elements are provided substantially symmetrical about the indexing axis.

In one arrangement, the first resilient coupling element attaches between the support portion and the driven portion about a first region of the body, and the second resilient coupling element attaches between the support portion and the driven portion about a second region of the body. In such arrangements, the first and the second regions of the body represent, respectively, opposite or opposing sides of the body. In this way, the driven portion and the support portion are coupled together in a manner which allows for the support portion to follow or pursue the movement of the driven portion, regardless of the direction the driven portion is moved.

In another embodiment, the first and second resilient coupling elements, when connected respectively to the support portion and the driven portion, are arranged about opposite sides of the tubular portion of the body. In this manner, either resilient coupling element is responsive so as to be extensible about a peripheral region of the body when either are acted upon by the driven portion—which will depend on the indexing position desired.

In some embodiments, the first and second resilient coupling elements may be arranged about the body so that they oppose one another, and provide a cooperative arrangement which, at least in part, serves to dampen or reduce any vibrational and/or shock forces which might be imparted to the support portion of the device during movement between the limit positions, and/or when the support portion engages with the mechanical stop so as to confirm registration in either of the limit positions. In this regard, engagement of the device at either the first or second limit positions can be such so that any impact therewith is reduced. Furthermore, such arrangements may also serve to reduce the transfer of any torque impulses to the device or body when drive is provided to the driven portion.

In some arrangements, the first and second resilient coupling elements are arranged so as to cooperate with one another so that they seek to encourage or maintain the desired relative alignment between the driven portion and the support portion. In this manner, the first and second resilient coupling elements can be arranged so that both are balanced such that substantially little or no net force (or torque) is applied to the device. In this balanced state, the support portion and the driven portion are aligned with one another in a substantially steady state equilibrium condition.

Movement of the driven portion causes the support portion to follow therewith in an effort to maintain or seek the relative alignment (or steady state equilibrium). Due to the resilient nature of each coupling element, the support portion is unlikely to cease movement at the instant the driven portion ceases movement. Instead, although the biasing force applied to the support portion by the resilient coupling element substantially reduces, the support portion is likely to overrun the stop position of the driven portion. Once the support portion overruns the stop position of the driven portion, a biasing response is provoked from the alternate resilient coupling element which then serves to bias the support portion toward the stop position of the driven portion. Depending on the dynamic circumstances surrounding the cessation of the movement of the driven portion, and the degree of resilience of the first and second resilient coupling elements, the support portion might oscillate about the equilibrium state a number of times until a steady or balanced state between both resilient coupling elements is reached. Thus, until the balanced state is reached, both first and second resilient coupling elements could transition to and from varying degrees of biasing states a number of times. Thus, the arrangement of the first and second resilient coupling elements serves to encourage or maintain a relative equilibrium condition between the driven portion and the support portion.

The drive portion may be configured so as to be controllable so that it decelerates to a lower relative speed as the support portion approaches an index or limit position so as to substantially reduce or minimise any shock force as the limit position is reached. Thereafter, the drive portion can be arranged to accelerate again so as to drive further in order to stretch or extend the relevant coupling element (such as for example, a coil spring) so as to apply an arbitrary holding (or biasing) force against the limit stop. For the case of a resilient coupling assembly comprising two resilient coupling elements arranged in a substantially opposing manner, it will be appreciated that an extension or stretching of one biasing element will cause or provoke a corresponding reduction of extension in the alternate resilient coupling element which serves to decrease the biasing effect, if any, it might have on the support portion.

In one embodiment, the first and second resilient coupling elements each comprise coil springs (ie. first and second coil springs). In such arrangements, the ends of the coil springs are connectable to the support portion and driven portion by way of one or more pins provided therewith. A coil spring is an example of an element in which resilience/compliance is inherited by way of form, ie. a single strand of material is arranged in a form (coil/helical) which confers its behavioural attributes.

In arrangements of the above, movement of the driven portion serves to place one of the first or second resilient coupling elements into a state of bias whereby the response of the relevant resilient coupling element is to bias the support portion to follow movement of the driven portion. Varying degrees of bias force may exist depending on the extension of the resilient coupling element. Persuasive movement of the support portion by way of one of the resilient coupling elements would suggest a lesser biasing influence offered by the alternate resilient coupling element. It will be appreciated that the degree of bias offered by each of the resilient coupling elements will depend on the movement of the driven portion. Thus, when arranged in a cooperative relationship, the first and second resilient couplings may each transition between varying states of bias depending on the direction and/or speed of movement of the driven portion. Therefore, although each resilient coupling element may be in a state of bias (for example, when both are arranged having a preloaded tension), each could exert varying degrees of bias. Furthermore, the first and second resilient coupling elements may transition between varying states of bias depending upon their respective modified forms (for example, the degree of extension for the case of a coil spring).

In one embodiment, when the driven portion and the support portion are stationary relative one another (ie. when indexing is not in operation), an amount of force (or torque) applied to the device by the first resilient coupling element is substantially balanced by an amount of force (or torque) applied to the device by the second resilient coupling element, the effect of which is that substantially no relative rotation between the support portion of the device and driven portion results. If the drive portion starts to drive the driven portion, then one of the first and second resilient coupling elements will begin to extend or stretch, while the other reduces in extension, and the torques that each apply to the device no longer balance. As such, the support portion will begin to move in response to the imbalance of the applied forces in the direction of the net force (or torque).

For the embodiments where the first and second resilient coupling elements both comprise coil springs, both coil springs may be arranged having substantially equivalent tension so that their respective coupling or biasing forces existing between the driven portion and the support portion are substantially equal. In one arrangement, the tension within each coil spring is configured so as to avoid either coil spring, when in a less extended state, closing its coils up completely and potentially bulging outward from the body of the apparatus. In this regard, the inventors have discovered through testing that arranging each spring in a preloaded manner, for example so that each coil spring extends to around 50% of about its maximum possible extension, or thereabout, provides sufficient response during operation. In this manner, both coil springs coupling the driven portion and the support portion are arranged in a steady state like equilibrium where each exhibit the same degree of preloaded tension. In this configuration, each serve to cooperate with one another in response to movement of the driven portion, ie., the extension in one caused by movement of the driven portion (and the associated lag in movement of the device), provokes a commensurate reduction in extension in the other (therefore reducing its predisposed bias of the device).

As foreshadowed above, in some embodiments, the arrangement of the first and second coil springs about the tubular portion of the body is such that the driven portion and the support portion, when so coupled, are biased to or toward a steady state condition relative one another when driven to a park or inactive state. The park state may be a position between the first and second index or limit positions. It will be appreciated that the steady state condition is one in which no net force acts upon the device to bias the device toward either of the first or second limit positions.

In one embodiment, the steady state condition is one which exists substantially between the first and second limit positions. The skilled reader will appreciate that the first and second coil springs can be configured such that the steady state condition can be at any desired orientation or relative alignment between both the driven portion and the support portion. For example, in some applications it may be desirous for the steady state condition to bias one of the first or second limit positions.

In another embodiment, the coupling assembly comprises a single unitary resilient coupling element arranged so as to associate the support portion and driven portion with one another. Embodiments of this form could employ, for example, a solid rubber coupling which connects the driven portion with the support portion. An embodiment of this nature exemplifies arrangements where the resilient/compliant attributes are primarily inherited from the material, and less from the physical form of the component.

In one embodiment, the single unitary resilient coupling element could be formed integral with the device, so associating, in a resilient yet integral manner, the driven portion with the support portion.

The skilled reader will appreciate that other materials and/or physical/geometrical forms offering resilient and/or compliant like characteristics could be adapted for use with various embodiments arranged according to the principal aspects described herein.

The drive portion may be provided in driving connection with the driven portion. In one arrangement, this is achieved by way of a mating pinion and ring gear set.

The drive portion may comprise a drive element configured for mounting eccentrically relative the indexing axis for rotation about a drive axis. The drive element may comprise a drive pin configured as a roller pin.

In some arrangements, transfer of drive to the driven portion is by way of a ring gear assembly having an annular ring gear associated with the driven portion and operable with a pinion gear associated with the drive assembly.

The drive element may be provided at one end of a drive shaft which has an axis of rotation and which is configured as a crank, with the drive element offset from the axis of rotation of the drive shaft.

The drive portion may further comprise an indexing drive motor drivingly coupled to the drive shaft for selectively rotating the drive shaft about its axis in either direction. Upon rotation of the shaft, the eccentric drive element is caused to move laterally through a circular path about the axis.

In one embodiment, where the sensor comprises a gyroscope, the latter may comprise a two-axis gyroscope mounted on the support portion (or body or chassis) such that the two sensitive axes are perpendicular to the indexing axis.

In another embodiment, where the sensor device comprises an accelerometer, the latter may comprise a two-axis accelerometer mounted on the support portion (or body or chassis) such that the two sensitive axes are perpendicular to the indexing axis.

The sensor device may comprise a composite device comprising a two-axis gyroscope and a two-axis accelerometer, with the respective sensitive axes perpendicular to the indexing axis. The two-axis gyroscope and a two-axis accelerometer may be interconnected for rotation in unison about the indexing axis.

In one embodiment, the sensor may comprise a dynamically tuned gyroscope (or DTG).

In another embodiment, the body is arranged to carry one or more sensors, and the support portion of the device is held stationary relative to the indexing axis. In this arrangement, the body is therefore arranged so as to move about the indexing axis. In such arrangements, substantially the same relative movement between the components occurs. Thus, whether the sensor(s) are carried by the device or the body (or chassis) will not adversely affect the operation of the apparatus.

In another embodiment, the apparatus includes a housing configured in a manner having sufficient stiffness and/or rigidity so as to, at least in part, assist in absorbing any vibrational energy which might be caused by one or more sensors carried by the device during operation.

According to a fourth principal aspect of the present invention, there is provided an apparatus for indexing a device about an indexing axis, the device having a support portion for supporting a sensor, the apparatus comprising:

an indexing drive mechanism comprising a drive portion configured for indexing the device about the indexing axis, the device having a driven portion arranged in driving engagement with the drive portion, the driven portion and the support portion operably associated with one another by way of a coupling assembly comprising a coupling element configured for resiliently associating the driven portion with the support portion, wherein the device is configured such that driving of the device is operable in a manner in which exposure of the support portion to any undesirable physical forces is reduced to at least some extent.

In one embodiment, driving of the device may be to or toward a state in which exposure of the support portion to any undesirable physical forces is reduced.

In another embodiment, the state in which exposure of the support portion to any undesirable physical forces is reduced is by way of a biased state in which the coupling assembly has transitioned to a state of bias.

In a further embodiment, the coupling element is configured such that the driven portion is resiliently operable and/or responsive in a manner in which exposure of the support portion to any undesirable physical forces is reduced.

According to a fifth principal aspect, there is provided an apparatus for indexing a device about an indexing axis, the device having a support portion for supporting a sensor, the apparatus comprising:

an indexing drive mechanism comprising a drive portion configured for indexing the device about the indexing axis, the device having a driven portion arranged in driving engagement with the drive portion, the driven portion and support portion operably associated with one another by way of a coupling assembly comprising more than one resilient coupling elements each arranged so as to resiliently associate the driven portion with the support portion, the coupling assembly configured so that the resilient coupling elements are capable of transitioning to/from a state of bias in a manner in which exposure of the support portion to any undesirable physical forces is reduced to at least some extent.

According to sixth principal aspect, there is provided an apparatus for indexing a device about an indexing axis, the device having a support portion for supporting a sensor, the apparatus comprising:

an indexing drive mechanism comprising a drive portion configured for indexing the device about the indexing axis, the device having a driven portion arranged in driving engagement with the drive portion, the driven portion and the support portion operably associated with one another by way of a coupling assembly comprising first and second resilient coupling elements each arranged so as to resiliently associate the driven portion with the support portion, the resilient coupling elements co-operable with one another for transitioning to/from a state of bias in a manner in which exposure of the support portion to any undesirable physical forces is reduced to at least some extent.

In some embodiments of the above principal aspects, the resilient coupling elements are arranged capable of transitioning to/from a state of bias such that the driven portion is operable and/or responsive in a manner in which exposure of the support portion to any undesirable physical forces is reduced.

As noted above, other embodiments of the apparatus can be realized by way of a second implementation. In such embodiments, the second body serves as the sensor carrying device (provided, in at least one embodiment, in the form of a body or chassis in a similar manner to that described above), but is provided with freedom to rotate about the indexing axis. In this manner, in at least one embodiment, the first body comprises a portion which is arranged so as to be fixed or stationary relative to the indexing axis, and a driven portion arranged in driving engagement with the drive means (provided generally by way of the indexing drive mechanism in a substantially similar manner to that described above). In this arrangement, the fixed or stationary portion and the driven portion of the first body are associated with one another in a manner in which exposure of the second body (or the sensor carrying device) to any undesirable physical forces is, at least to some extent, reduced.

It will be understood that the same relative movements inherent with embodiments of the first implementation are applicable to embodiments of the second implementation and thus many of the structural, operational, and conceptual features described above continue to apply to embodiments where the device (now the second body) is free to rotate about the indexing axis. Thus, any of the features described above in relation to the first implementation may be configured or adapted for use with any of the embodiments of the apparatus of the following principal aspects described below.

Accordingly, embodiments of the seventh to eleventh principal aspects relate particularly to embodiments of the invention when configured in accordance with the second implementation.

Accordingly, in a seventh principal aspect, there is provided an apparatus for indexing a device about an indexing axis, the apparatus comprising:

an indexing drive mechanism comprising a drive portion configured in driving engagement with a driven member for indexing the device about the indexing axis, wherein the driven member is configured such that driving of the device is operable in a manner in which exposure of the device to any undesirable physical forces is reduced to at least some extent.

According to an eighth principal aspect, there is provided an apparatus for indexing a device about an indexing axis, the apparatus comprising:

an indexing drive mechanism comprising a drive portion configured in driving engagement with a driven member for indexing the device about the indexing axis, wherein the driven member is configured so that the device can be driven to or toward a state in which exposure of the device to any undesirable physical forces is reduced to at least some extent.

In one embodiment, the driven member is configured having a driven portion arranged in driving engagement with the drive portion.

In one embodiment, the state in which exposure of the device to any undesirable physical forces is reduced is a biased state.

In one embodiment, the device is arranged to carry a sensor according to any manner described herein.

In another embodiment, the device is arranged to carry the indexing mechanism according to any manner described herein.

In other embodiments, the configuration of the device is substantially similar to the second body of the first implementation described above (which, in those embodiments, was arranged stationary relative to the indexing axis). Driving engagement between the indexing mechanism and the driven member for various embodiments of the second implementation is configured in substantially the same manner as the index mechanism and the driven portion of embodiments of the first implementation described above, so allowing for the same relative movements to occur.

In one embodiment, the driven member is arranged in operable association with an assembly comprising at least one resilient coupling element, the assembly configured such that the driven member is operable and/or responsive in a manner in which exposure of the device to any undesirable physical forces is reduced.

In another embodiment, the assembly is configured so as to resiliently associate the driven member with a support, the support arranged so as to be fixed or restrained from movement relative to the indexing axis. The support may be associable with or be part of an external housing provided, for example, by way of a down hole survey instrument or tool with which embodiments of the apparatus are associated with for operation.

In another embodiment, the resilient coupling elements are arranged capable of transitioning to/from a state of bias such that the driven member is operable and/or responsive in a manner in which exposure of the device to any undesirable physical forces is reduced.

In a further embodiment, the assembly is a coupling assembly, the coupling assembly comprising first and second resilient coupling elements arranged co-operable with one another for transitioning to/from a state of bias such that the driven member is operable and/or responsive in a manner in which exposure of the device to any undesirable physical forces is substantially reduced.

In one embodiment, the coupling assembly comprises one as described in respect of embodiments of the first implementation. In this regard, the skilled reader will appreciate that any such association or coupling between the driven portion and the support (of the second implementation) may be configured in accordance with any of the embodiments of the coupling arrangements described in relation to the first implementation. Furthermore, it will be understood that the function and operation of these arrangements would be expected to apply to the presently described embodiments of the second implementation. Thus, any of the features described above in relation to the first implementation may be understood as being incorporated as appropriate here (in the context of the second implementation variations).

In one embodiment, the device comprises a limit means as described above in the relation to the first implementation, that being a mechanical stop provided with a body of the device. For example, the mechanical stop may be provided in the form of an elongate rod or pin extending or projecting from the device's body.

Similarly, embodiments of the support may comprise a circumferentially aligned slot arranged in accordance with the required indexing scope (eg. allowing for about 180 degrees). In one form (as described above), opposing ends of the slot may be provided with limit pins embedded therein, each limit pin corresponding to respective index positions.

As the reader will appreciate, in embodiments where the support is fixed, drive provided by the drive portion to the driven portion serves to cause relative movement there between. With the support stationary relative to the indexing axis and the association between the driven portion and the support sufficiently resilient, drive provided by the drive portion serves to rotate the device about the indexing axis. In this manner, it is the mechanical stop that rotates about the indexing axis to or toward a stationary limit pin carried by the support.

Movement of the device about the indexing axis will continue until the mechanical stop is brought into engagement with one of the limit pins corresponding to an intended index position. Once this engagement occurs, further driving of the driven portion serves to test the resilience of the association between the support and the driven portion. In this manner, once the device reaches an intended indexing position (by way of the mechanical stop engaging with one of the limit pins), further driving of the driven portion begins to rotate the driven portion about the indexing axis. As such, the resilient association between the driven portion and the support serves to bias or urge the mechanical stop against the limit pin. In this manner, the mechanical stop is effectively held or urged against the limit pin in the index position. As noted above, the motor unit can be configured (in the manner described above) to be electrically shorted so as to brake the motor and maintain the biased state. In this state, when the association between the driven portion and the support is resilient in nature, exposure of any undesirable forces to any sensor carried on the device can be, at least in part, reduced.

As described above, the drive portion may be operable to drive the device to a position which is substantially intermediate the index positions—such as a 'park' or inactive position. In this manner, the association between the driven portion and the support is configured such that exposure of the device to any undesirable forces to any sensor carried on the device can be, at least in part, reduced.

According to a ninth principal aspect, there is provided an apparatus for indexing a device about an indexing axis, the apparatus comprising:

an indexing drive mechanism comprising a drive portion configured in driving engagement with a driven member for indexing the device about the indexing axis, the driven member arranged in operable association with an assembly comprising at least one resilient element arranged so as to be capable of transitioning to/from a state of bias such that exposure of the device to any undesirable physical forces is reduced to at least some extent.

In one embodiment, the or each resilient element is a resilient coupling element, the assembly configured operable with the driven member such that the driven member is responsive in a manner in which exposure of the device to any undesirable physical forces is substantially reduced.

In another embodiment, the assembly is configured so as to resiliently associate the driven member with a support, the support arranged so as to be fixed or restrained from movement relative the indexing axis.

In a further embodiment, the indexing mechanism is configured for indexing of the device between first and second index positions about the indexing axis, the first and second index positions configured so as to allow a scope of travel therebetween of about 180 degrees.

In one embodiment, the driven member is of tubular form and arranged to surround a portion of a body of the device, the driven member and the body of the device aligned concentric with the indexing axis, the driven member and the device configured so as to be capable of rotation relative one another about the indexing axis.

In another embodiment, the support is of tubular form and arranged so as to surround a portion of the body of the device adjacent to the driven member, the support and the second portion of the device aligned concentric with the indexing axis.

In a further embodiment, said assembly comprises first and second resilient coupling elements configured so as to resiliently couple the driven member with the support, the first and second resilient coupling elements arranged in a symmetrical manner about a region of the body relative to the indexing axis so as to provide an arrangement in which both resilient coupling elements co-operate to, at least in part, dampen or reduce any vibrational and/or shock forces which might be imparted to the device during operation.

In another embodiment, the first and second resilient coupling elements comprise opposite free ends, one free end of each of the first and second resilient coupling elements attached to the driven member adjacent each other, and the alternate free end of each of the first and second resilient coupling elements attached to the support adjacent each other, the points of attachment provided with the driven member substantially opposing the points of attachment provided with the support relative to the indexing axis.

In one embodiment, the first and second resilient coupling elements are arranged having substantially equivalent tension so that their respective coupling or biasing forces existing between the driven member and the support are substantially equal when the device is at a position intermediate the first and second index positions.

In another embodiment, the apparatus comprises a limit means configured so as to confirm the device in the first or second index positions when indexed thereto.

In a further embodiment, the limit means comprises a stop member fixed relative to the device and projecting radially away therefrom, the limit means configured so that rotation of the device allows the stop member to be brought to bear against a first region of the support to confirm registration of the device in the first index position when indexed thereto, and against a second region of the support to confirm registration of the device in the second index position when indexed thereto.

In another embodiment, the first and second regions of the support are provided in the form of opposing regions of a circumferentially aligned slot provided with the support.

In a further embodiment, the driven member is operable with the first and second resilient coupling elements such that driving of the driven member beyond one of the first or second index positions causes the device to be biased to the intended index position when driving of the driven member is ceased.

In one embodiment, the device is arranged to carry one or more sensors comprising any of the following: accelerometers, gyroscopes, physical switches, magnetometers, vibration sensors, inclinometers, inductive RPM sensors.

In another embodiment, the device is configured so as to carry the indexing drive mechanism.

In one embodiment, the drive portion comprises a drive element configured for mounting with the device eccentrically relative to the indexing axis.

In another embodiment, transfer of drive to the driven member is by way of a ring gear assembly having an annular ring gear associated with the driven member and operable with a pinion gear associated with the indexing drive mechanism.

In a further embodiment, the association between the driven member and the assembly is such that the driven member is operable in a manner in which exposure of the device to any undesirable physical forces is reduced to at least some extent.

According to a tenth principal aspect, there is provided an apparatus for indexing a device about an indexing axis, the apparatus comprising:

an indexing drive mechanism comprising a drive portion configured in driving engagement with a driven member for indexing the device about the indexing axis, the driven member arranged in operable association with an assembly comprising more than one resilient elements arranged so as to be capable of transitioning to/from a state of bias such that exposure of the device to any undesirable physical forces is reduced to at least some extent.

According to an eleventh principal aspect, there is provided an apparatus for indexing a device about an indexing axis, the apparatus comprising:

an indexing drive mechanism comprising a drive portion configured in driving engagement with a driven member for indexing the device about the indexing axis, the driven member arranged in operable association with an assembly comprising first and second resilient coupling elements arranged co-operable with one another for transitioning to/from a state of bias such that exposure of the device to any undesirable physical forces is reduced to at least some extent.

According to another principal aspect, there is provided a method comprising operably configuring an embodiment of an apparatus or survey instrument according to any of the principal aspects described herein.

Embodiments of the present principal aspect may be configured or adapted so as to be applicable to either implementation described above in relation to the second to eleventh principal aspects, that is with method steps corresponding to functions performed by any one or more features of the apparatus described herein.

According to a further principal aspect, there is provided a method for operating an apparatus arranged for indexing a device about an indexing axis for use in a down hole surveying operation, the method comprising:

providing an apparatus arranged in accordance with any of the aspects of the apparatus described herein;

associating the apparatus with a down hole surveying tool or survey instrument so that the apparatus is operable therewith;

causing the apparatus to drive the device about the indexing axis to, toward, or from an index position.

In one embodiment, the method comprises causing the apparatus to hold the device at an index position for a predetermined period of time before driving the device toward another index position so as to be held there at for about the predetermined period of time.

In another embodiment, the method comprises causing the apparatus to reduce the speed of driving the device about the indexing axis as the device approaches an intended index position.

In a further embodiment, the method comprises causing the apparatus to increase the speed of driving the device about the indexing axis in the direction of the intended index position once the device has reached said index position.

In another embodiment, the method comprises:

causing the apparatus to continue to drive the device in the direction of an intended index position once said intended index position has been reached; and causing the apparatus to cease driving the device such that the device is biased at the intended index position.

In another embodiment, the method comprises driving the device between a first index position and a second index position in a consecutive manner during the course of a predetermined period of time.

In one embodiment, the method comprises causing the apparatus to drive the device to a park or inactive position, the apparatus configured in a manner in which exposure of the device to any undesirable physical forces when the device is in said park or inactive position is substantially reduced.

According to another principal aspect, there is provided a coupling assembly arranged for use with an indexing apparatus, the coupling assembly configured operable with the apparatus in a manner in which exposure of a portion of the apparatus to any undesirable forces is substantially reduced.

In one embodiment, the portion of the apparatus is configured for carrying or supporting a sensor.

In another embodiment, the coupling assembly is arranged in accordance with any of the embodiments of the assembly or coupling assembly described herein.

In another embodiment, the apparatus is arranged in accordance with any of the embodiments of the apparatus of the principal aspects described herein.

According to another principal aspect of the present invention, there is provided a down hole surveying instrument or tool incorporating an embodiment of an apparatus according to any of the principal aspects described herein.

According to a further principal aspect, there is provided a method for performing a down hole surveying operation using a survey instrument, the method comprising:

recording data measured from a sensor when provided at a first measurement position and a second measurement position;

acknowledging the time the data was recorded by way of a first timer;

acknowledging by way of a second timer, a point in time during the surveying operation, the first and second timers arranged so as to be synchronised with one another; and identifying data recorded after said recorded point in time for use in preparing a survey report.

The method of the above described principal aspect, and those which follow, may comprise any of the following features:

In one embodiment, acknowledging the time the data was recorded by way of the first timer comprises associating the time the data was recorded with the corresponding recorded data. In another arrangement, acknowledging the time the data was recorded by way of the first timer comprises recording the time the data was measured (and/or recorded).

In another embodiment, acknowledging the point in time during which data is recorded comprises recording said time.

In one embodiment, the survey report is prepared using data measured during a measurement cycle, the measurement cycle comprising data measured at the first measurement position and the second measurement position.

In another embodiment, the survey report is prepared using data measured at the first measurement position and the second measurement position when taken in a consecutive manner.

In one embodiment, the survey instrument incorporates an apparatus according to any of the embodiments arranged in accordance with the apparatus of the above described principal aspects.

In another embodiment, the first timer is associated with the survey instrument or the apparatus and the second timer is remote from the survey instrument during operation.

In one embodiment, the sensor comprises a sensor device in the form of a gyroscope. The sensor device, however, may be of any appropriate type; for example, the sensor device may comprise one or more of the following: accelerometers, gyroscopes, physical switches, magnetometers, vibration sensors, inclinometers, inductive RPM sensors, flow sensors and pressure sensors, or any suitable combination.

For embodiments of the survey instrument which are arranged in accordance with the apparatus of any of the above principal aspects, the sensor device may be carried by the device of the apparatus.

In one embodiment, the survey instrument is inserted into the borehole. Once so inserted, the survey instrument may be arranged to measure at the first and second measurement positions (ie. index position) for the duration of a survey period. In some arrangements, the survey period is substantially the entire time while the survey instrument is downhole. Such measuring may occur on a substantially continuous and/or consecutive basis.

In one embodiment, the commencement of the survey period is pre-defined. For example, the survey period may be arranged to commence following insertion of the survey instrument into the borehole.

In another embodiment, while during the survey period, the survey instrument alternates measurement or recording of measured data between the first and the second measurement positions (or vice versa).

In other embodiments, measuring at each index (ie. the first and the second measurement positions) position may occur over a finite time period. In such embodiments, the finite time period is selected prior to operation. In this manner, the survey instrument may be configured so that the finite time period commences at a time, for example, when the operator believes the survey instrument is likely to be in a position down hole at a location in the borehole where a survey report is wanted. In some embodiments, this commencement time is programmed into the survey instrument.

In one embodiment, the preparation of the survey report requires a set of measured data taken at either the first or second measurement positions to be known as having been taken prior to measurement data being taken from the alternate measurement position. This known measurement position may serve as a reference measurement position used when preparing the survey report.

In one embodiment, the survey report is prepared using data measured by the sensor unit(s) at each measurement position consecutively. In some configurations, commencement of the survey report is premised on the preselected measurement position serving as a reference measurement position for the preparation of the survey report. In one arrangement, one of the first or second measurement positions is selected as the reference measurement position for commencing preparation of the survey report. For example, for the case where the first measurement position is selected as the reference measurement position, a survey report may be prepared using a set of data taken from the first measurement position, followed by a set of data taken from the second measurement position consecutively. In such embodiments, it will be understood that the sensor requires indexing back to the reference measurement position before another survey report can be sought.

In another embodiment, the preparation of the survey report can be configured so as to consider consecutive sets of measured data regardless of any stipulation or requirement for a reference measurement position for commencing the preparation of the survey report. In this manner, it will be appreciated that a further survey report can be determined by not requiring the sensor to be indexed back to the reference measurement position. Thus, a survey report can be prepared from two consecutive survey measurements. For example, a survey report can be prepared from measurement data taken when measured at the first measurement position, followed by data measured at the second measurement position. However, in the same survey operation, a survey report can also be prepared from measurement data taken at the second measurement position, followed by survey measurement data taken at the first measurement position. In arrangements of this nature, it will be understood that it is the consecutive nature of the survey measurements which allows for the survey report to be determined. It will be understood that arrangements of this nature can be advantageous in that a valid survey report can be determined independent of the order in which the survey measurements are taken. As noted, in these arrangements, there is no need to index the sensor back to a selected reference measurement position.

In another embodiment, substantially all data acquired by the sensor is recorded to storage, such as an appropriate memory module associated or provided with the survey instrument or apparatus.

In some embodiments of the proposed method where the sensor comprises a gyroscope, gyroscopic data acquisition in each of the first and second measurement positions may typically take in the order of about 40 seconds.

In another embodiment, movement or indexing of the gyroscope from one measurement position to the other measurement position may take in the order of about 10 seconds. Thus, in some embodiments, a survey or measurement process from initiation to completion may take about 90 seconds in total, ie. consisting of about 40 seconds in the first measurement position, about 10 seconds indexing between the first measurement position to the second measurement position, and about 40 seconds in the second measurement position.

In one embodiment, the method includes the use of an appropriate controller module or suitable processing apparatus provided remote from the instrument during the surveying operation. The controller module may comprise computing means, in which case it will be appreciated that the controller module could be provided in the form of any suitable processing device such as a laptop or like portable device such as a handheld computer or smart phone.

In one embodiment, the controller module is provided at the surface of a borehole surveying operation.

In one embodiment of the method, knowledge may be generated via processing of relevant data and/or information. In such an embodiment, the controller module uses its generated knowledge of the synchronised events occurring in the survey instrument when down-hole (eg. substantially continuous recording of measured data at each of the first and second measurement positions, in turn) to facilitate the production of information which serves to report (for example to the user) once two complete consecutive measurements have been acquired and the survey considered complete. This reporting is possible once the survey instrument has been retrieved and its recorded data synchronised by the controller module.

In one arrangement, the second timer is associated with the controller module at the surface (eg. the controller module may include an internal timer), the second timer being arranged so as to be synchronized substantially with the first timer associated with the survey instrument. The controller module is therefore able to determine what events are occurring, and/or when, in the survey instrument without the need for a real time communication link between the controller and the survey instrument. In this manner, it can be determined by the controller when two complete and consecutive survey measurements have been made, ie. one survey measurement in each index or measurement position, and advise the user that the survey is complete. Thus, the controller module is able to advise or inform the operator (at the surface) once measurements in both index/measurement positions have been made and/or that the survey is complete. The operator is then free to retrieve the survey instrument or move it to a new survey position.

In one arrangement, the recorded data includes information corresponding substantially with the time each set of measured data was taken (for example, all data recorded by the sensor may be appropriately time stamped using the first timer as a reference).

In another embodiment, the method includes operation of the controller module at the surface, typically operable by a human user such as for example a driller.

In one embodiment, the user may request a survey to be made at any time during the survey period—this may be provoked, for example, by the survey instrument having substantially reached a desired location (for example depth) in the borehole.

The request made by the user may be acknowledged by way of the controller module which records the time the request was made. The time the request was made by the user may be recorded with reference to the second timer.

The second timer may be synchronised with the first timer associated with the survey instrument prior to insertion of the survey instrument in the borehole. Accordingly, synchronisation of the first and second timers ensures that the data measured by the survey instrument can be identified accurately relative to the time the request was made by the user (by reference to the second timer).

In one embodiment, once the survey has been completed and the survey instrument is back at the surface, the data from the survey instrument and the data from the controller module is synchronised. In such arrangements, the measured data from the survey instrument may be input into the controller module, or may be combined with any data recorded by the controller module.

It will be appreciated that the recording of the data down-hole by the survey instrument would, in many embodiments, be stored on storage such as a memory module of any suitable configuration associated with the survey instrument.

In one form, input of the recorded data into the controller module and synchronisation with the controller module data may involve a transfer from the memory module associated with the survey instrument to the memory module associated with the controller module. The skilled reader would appreciate that any conventional data synchronisation (and associated hardware) solution could be used.

In another arrangement, once the survey instrument and the controller module are synchronised with one another (ie. when 'initialized'), the survey instrument continuously moves the sensor from one indexing or measurement position to the other so that the sensor is able to sample for a known period of time (in one embodiment, this known time period may be in the order of substantially 40 seconds).

In a further embodiment, a new survey (which may include, for example, two consecutive measurements) may commence on a substantially regular basis (for example, every two minutes). In this manner, the survey start or commencement times can be determined. For example, for the case where the survey commences substantially every two minutes, the relevant survey commencement times will be about 0-2-4-6-8 minutes (etc) after initialization.

In another embodiment, the time needed for performing a survey measurement at either of the first or second measurement positions is in the order of about 40 seconds. Furthermore, the time taken for indexing the sensor between either measurement position is in the order of about 5 seconds. For embodiments where the survey result can be prepared regardless of whether the survey measurement data from the first or second measurement positions is used as the reference measurement position, it is possible to commence a new or further survey at substantially every minute or thereabouts. Thus, as compared with some embodiments described above, a fresh survey can be initiated about every 60 seconds or thereabouts, rather than about every 2 minutes (as in the embodiment described above).

In another embodiment, if at any time at the surface the user wishes to request a survey (or record a survey start time), the controller module is arranged so that, in response, it estimates the time the survey (for example, once two consecutive measurements—one measurement at each measurement position—have been taken) is expected to be completed. This therefore defines a period of time during which a survey is estimated to be completed. In this manner, once the survey instrument has been retrieved and the data available for interrogation, the controller module is configured so as to identify recorded data that corresponds with the period of time during which the survey is thought to have completed. Once the data is identified, it may then be isolated or extracted for processing purposes (eg. for preparing a survey report).

In one embodiment, two complete and consecutive measurements from the first and second measurement positions following the time at which the survey was requested can be used to compute and determine the survey result. The collected data is processed so as to perform the appropriate calculation for the first measurement position, followed by the second measurement position, or vice versa if applicable. In this manner, the data collected in each of the two indexing or measurement positions is then processed (for example, by way of a mathematical routine) to generate a measurement of azimuth. It will be understood that it does not matter in which order the indexing positions are visited.

In one arrangement, the controller module may be configured so that the user can pre-set or predefine a preferred number of surveys to be taken.

In another embodiment, the survey instrument is configured so that recording of data is initiated or triggered by one or more further sensor(s) provided with the survey instrument sensing or seeking to detect the current state of the survey instrument when down hole.

In one embodiment, the current state of the survey instrument could be determined from analysis of one or more signals received from one or more sensor units associated with the survey instrument.

For example, rather than commencing a measurement cycle at a pre-defined time interval, for example, every minute, the survey instrument could, for example, be configured so as to employ its on-board sensor units to make a determination as to whether the survey instrument is stationary. In one arrangement, for example, such a determination could be made by the survey instrument seeking to determine whether the survey instrument has remained substantially stationary (or has remained sufficiently stationary) for a prescribed period of time during which signals from one or more sensor units associated with the survey instrument are monitored (monitoring period).

In one embodiment, the determination of the survey instrument remaining sufficiently stationary may require one or more sensor units becoming operational during the monitoring period. The monitoring period may be in the order of, for example, 10 seconds, but could be any appropriate nominated time period considered sufficient for making such a determination. It would be appreciated that various practical factors could inform the quantum of such a time period, such as for example, power consumption considerations, the type of sensor being relied upon, and/or the geologic nature of the site sought to be surveyed.

In another embodiment, the determination of the survey instrument remaining sufficiently stationary may require one or more sensor units becoming operational for the monitoring period for the purposes of measuring or testing for the current state of the survey instrument.

For example, the current state of the survey instrument may comprise a physical state of the survey instrument, which is affirmed when a signal received from a sensor unit is considered to be above or below about a prescribed level, or within a prescribed range. For example, the survey instrument could be configured so as to monitor signals from an accelerometer unit, the signals being processed in a manner which provides an indication of physical vibration experienced by the survey instrument when said accelerometer unit is operational during the monitoring. If, for example, a measured signal, when processed in an appropriate manner to determine a corresponding vibration level, falls below a prescribed threshold or is determined to reside within a prescribed range or ranges considered to reflect a stationary state for the prescribed period of time, the determination is made or affirmed that the survey instrument is stationary and a measurement cycle can commence.

In one embodiment, if a determination has been made that the survey instrument has remained sufficiently stationary for the monitoring period, then the survey instrument can be configured so that a measurement cycle automatically commences.

In another embodiment, if a measured signal or determined vibration level exceeds a prescribed threshold or is determined to reside within a prescribed range or ranges considered to reflect a non-stationary state, the determination is made that the instrument is non-stationary. In this instance, the survey instrument may be configured so that a measurement cycle is unable to commence. In such cases, the survey instrument may be configured so as to recommence the monitoring period at a future time.

Recommencement of the monitoring period may occur at prescribed regular or non-regular intervals.

In a further embodiment, if the determination is made that the survey instrument is stationary, and a measurement cycle is commenced, the survey instrument may be configured so as to continue testing or monitoring to determine whether the current state of the survey instrument changes for the remainder of the current measurement cycle. The testing or monitoring for such occurrence may be substantially similar to that described above. If, for example, the current state of the survey instrument were to be determined to have changed (ie. changing from stationary to non-stationary), then the survey instrument could be configured to cease recording/measuring data.

In another embodiment, the survey instrument could be configured to continue measuring for the remainder of the current measurement cycle if the state of the survey instrument were determined to have changed (ie. from stationary to non-stationary). In such instances, any measurement data recorded during the measurement cycle following the change of state of the survey instrument, such measured data may be associated with an appropriate indicator indicating that such data was measured following determination of the change of state.

In another embodiment, for the case where the state of the survey instrument being tested for is whether a stationary or non-stationary state exists, if the survey instrument is determined to have not remained sufficiently stationary for the completion of a measurement cycle (for example, about 2 minutes), then the measured survey data recorded during that period is discarded (or, for example, deleted from an on-board memory module), or retained, but, if retained, associated with an appropriate indicator indicating that the measured survey data may be invalid for subsequent processing purposes.

In a further embodiment, the survey instrument may be configured so that the occurrence of any change of state of the survey instrument detected during the present measurement cycle (or a survey period) and/or the monitoring period which is considered to be unfavourable for measurement purposes, has the effect of restarting the monitoring period. In this manner, any data so recorded can either be discarded/deleted or retained, but, if retained, associated with an appropriate indicator indicating that the measured survey data may be invalid for subsequent processing purposes.

In embodiments described above where the measurement cycle can be initiated or triggered by testing for a current state of the survey instrument, the first and second timers remain synchronized with one another. The operator records the time during the survey period when it is considered (by the operator/user at the surface) that the survey instrument is stationary at the desired location down hole. The controller module at the surface will then seek to capture or record the time so as to be able to isolate the relevant measured survey data once synchronised with the survey instrument when it is back at the surface.

In one embodiment, the controller module may be arranged so as to provide and display a further timer to the operator/user indicating the estimated elapsed time as the measurement cycle progresses. For example, in one embodiment, the controller module is configured to display a timer to the operator/user showing a wait time reflective of the duration of a measurement cycle.

In one embodiment, the measurement cycle commences once the time duration of the monitoring period expires. Thus, the time needed for the survey instrument to remain stationary for measuring is the time duration of the monitoring period plus the time duration of the measurement cycle. However, in some environments, time may be of the essence and any effort which makes efficient use of time can be advantageous. Therefore, in another embodiment, the survey instrument can be configured so as to measure data during the monitoring period at the same time the instrument is testing for the current state of the survey instrument, for example, to determine whether the instrument is in a stationary state. As such, in one arrangement, the survey instrument may be configured so as to continuously record signals received from any of the relevant measuring sensors during the monitoring period.

In one arrangement, the signals from the sensor may be continuously recorded into a buffer module having a prescribed size during the monitoring period. In one embodiment, the prescribed size of the buffer may be arranged so as to comprise sufficient capacity for retaining measured data recorded during the duration of the monitoring period. When the monitoring period expires and the survey instrument is affirmed as being in a stationary state (as described above), then the measured data recorded to the buffer may be used in the preparation of the survey report, and therefore part of the measurement cycle and processed accordingly for preparing the survey report. In this manner, acceptance of the data measured and recorded during the monitoring period serves to avoid any potential need to extend the measurement cycle by, for example, the 10 seconds stationary detection period. Thus, in environs where time is of the essence, the survey instrument need only be substantially stationary for the time needed for the measurement cycle to complete.

In one embodiment, for the case where the sensor comprises a gyroscope, the raw measured data is corrected using a calibration file that can be associated with the survey instrument or apparatus. In other embodiments, the calibration file can be associated with the controller module on the surface.

In some embodiments, the calibration file can be associated with a handheld unit when provided as the controller.

Where an accelerometer is included, the accelerometer data can be corrected using the calibration file. In some arrangements, error terms in the gyroscope data may need to be corrected using the accelerometer data. With the corrected sensor signals, the static bias can be estimated/determined. For configurations where there is provided substantially 180 degrees of rotation between the two indexing or measurement positions, it can be assumed that the corrected gyroscope signals have the substantially same magnitude but opposing signs. By way of a brief simple example, a simplified equation might look as follows:

Gyroscope data in index position 1: $wx1=+wx+\text{Bias}$

Gyroscope data in index position 2: $wx2=-wx+\text{Bias}$ $\text{Bias}=(wx1+wx2)/2$ For situations where the bias is known, the azimuth can be derived from either one of the index or measurement positions.

According to another principal aspect of the present invention, there is provided a system for conducting a survey of a portion of a bore hole, the system comprising:

a survey instrument arranged for recording data measured from a sensor carried by the instrument when indexed between a first measurement position and a second measurement position during a survey period, the instrument having a first timer, a controller module provided remote from the instrument, the controller module having a second timer arranged so as to be substantially synchronised with the first timer, the controller module configured for identifying data recorded by the survey instrument from about a known point in time during the survey period, the controller module further configured for processing the identified data for providing a survey report.

The system of the present aspect may be arranged so as to carry out any of the embodiments of the method for performing a down hole surveying operation described herein. Accordingly, embodiments of the components of the system of the present aspect may be arranged so as to incorporate features and/or carry out steps described in relation to the principal aspects described above.

In one embodiment, the survey instrument incorporates an embodiment of an apparatus as described herein.

In one embodiment, the sensor comprises one or more of any of the sensors described herein.

In one embodiment, the survey instrument is arranged to measure at each of the first and second measurement positions for the duration of a survey period. In some arrangements, the survey period is substantially the time while the survey instrument is down-hole. Such measuring may occur on a substantially continuous and/or consecutive basis.

In one embodiment, while during the survey period, the survey instrument alternates measurement or recording between the first and the second measurement positions (or vice versa).

In one embodiment, the first and second measurement positions correspond with a respective index position.

In another embodiment, substantially all data acquired by the sensor is recorded to an appropriate storage, such as a memory module associated or provided with the survey instrument or apparatus.

In another embodiment, movement or indexing of the sensor (eg. a gyroscope) from one measurement position to the other measurement position may take in the order of about 10 seconds. Thus, in some embodiments, a survey or measurement process from initiation to completion may take about 90 seconds in total, ie. consisting of about 40 seconds in the first measurement position, about 10 seconds indexing between the first measurement position to the second measurement position, and about 40 seconds in the second measurement position.

In one embodiment, the controller module includes the use of an appropriate processing means. The controller module may comprise computing means, in which case it will be appreciated that the controller module could be provided in the form of any suitable processing device such as a laptop or like portable device such as a handheld computer or smart phone.

In one embodiment, knowledge may be generated via processing of relevant data and/or information. In such an embodiment, the controller module uses its generated knowledge of the synchronised events occurring in the survey instrument when down-hole (the substantially continuous recording of measured data at each of the first and second measurement positions, in turn) to facilitate the production of information which serves to report (for example to the user) once two complete consecutive measurements have been acquired and the survey considered complete. This reporting is possible once the survey instrument has been retrieved and its recorded data synchronised by the controller module.

In one embodiment, the controller module at the surface is arranged so as to be associated with the second timer, the second timer being arranged so as to be synchronized substantially with the first timer associated with the survey instrument. In this manner, it can therefore be determined when two complete and consecutive measurements have been made, ie. one in each index or measurement position, and advise the user that the survey is complete.

In one arrangement, the recorded data includes information corresponding substantially with the time each set of measured data was taken (for example, all data recorded by the sensor may be appropriately time stamped using the first timer as a reference).

In another embodiment, operation of the controller module is at the surface of the surveying operation, typically operable by a human user such as for example a driller.

In one embodiment, the known point in time is provided by way of the user acknowledging or requesting a survey to be made at any time during the survey period—this may be provoked, for example, by the survey instrument having substantially reached a desired location (for example depth) in the borehole.

The request made by the user may be acknowledged by way of the controller module which records the time the request was made. The time the request is made by the user may be recorded by reference to the second timer.

The second timer may be synchronised with the first timer associated with the survey instrument prior to insertion of the survey instrument in the borehole. Accordingly, synchronisation of the first and second timers ensures that the data measured by the survey instrument can be identified accurately relative to the time any request was made by the user (by reference to the second timer).

In one embodiment, once the survey has been completed and the survey instrument is back at the surface, the data from the survey instrument and the data from the controller module is synchronised. In such arrangements, the measured data from the survey instrument may be input into the controller, or may be combined with any data recorded by the controller module. In this manner, the data recorded by the survey instrument can be interrogated in an appropriate manner.

It will be appreciated that the recording of the data down-hole by the survey instrument would, in many embodiments, be stored on storage such as a memory module of any suitable configuration associated with the survey instrument.

In one form, input of the recorded data into the controller module and synchronisation with the controller data may involve a transfer from the memory module associated with the survey instrument to a memory module associated with the controller module. The skilled reader would appreciate that any conventional data synchronisation (and associated hardware) solution could be used.

In another arrangement, once the survey instrument and the controller module are synchronised with one another (ie. when 'initialized'), the survey instrument continuously moves the sensor from one indexing or measurement position to the other so that the sensor is able to sample for a known period of time (in one embodiment, this known time period may be in the order of substantially 40 seconds).

In a further embodiment, a new survey (which may include, for example, two consecutive measurements) may commence on a substantially regular basis (for example, every two minutes). In this manner, the survey start or commencement times can be determined. For example, for the case where the survey commences substantially every two minutes, the relevant survey commencement times will be about 0-2-4-6-8 minutes (etc) after initialization.

In another embodiment, if at any time at the surface the user wishes to request a survey (or record a survey start time), the controller module is arranged so that, in response, it estimates the time the survey (for example, once two consecutive measurements—one measurement at each measurement position—have been taken) is expected to be completed. This therefore defines a period of time during which a survey is estimated to be completed. In this manner, the controller module is configured so as to, once the survey instrument has been retrieved and the data available for interrogation, identify recorded data that corresponds with the period of time during which the survey is thought to have been completed. Once the data is identified, it may then be isolated or extracted for processing purposes (eg. for preparing a survey report).

In one embodiment, two complete and consecutive measurements from the first and second measurement positions following the time at which the survey was requested can be used to compute the survey result. The collected data is processed so as to perform the appropriate calculation for the first measurement position, followed by the second measurement position, or vice versa if applicable. In this manner, the data collected in each of the two indexing or measurement positions is then processed (for example, by way of a mathematical routine) to generate a measurement of azimuth. It will be understood that it does not matter in which order the indexing positions are visited.

In some embodiments, the survey instrument of the present aspect may be arranged in accordance with any of the embodiments of the survey instrument described herein.

In some embodiments, the survey report may be prepared in accordance with any of the embodiments of the method for performing a down hole surveying operation described herein.

In some embodiments, the controller module may be configured in accordance with any of the embodiments of the method for performing a down hole surveying operation described herein.

The system of the present aspect may allow for use of a calibration file as described above. The calibration file may be used by the controller or the survey instrument in real time during the survey period or by the controller as part of the processing stage once the survey instrument has been retrieved.

According to another principal aspect, there is provided a computer-readable storage medium on which is stored instructions that, when executed by a computing means, causes the computing means to perform any of the embodiments of the method for performing a down hole surveying operation described herein.

According to a further principal aspect, there is provided a computing means programmed to carry out any of the embodiments of the method for performing a down hole surveying operation described herein.

According to another principal aspect, there is provided a data signal including at least one instruction being capable of being received and interpreted by a computing system, wherein the instruction implements any of the embodiments of the method for performing a down hole surveying operation described herein.

Various principal aspects described herein can be practiced alone or in combination with one or more of the other principal aspects, as will be readily appreciated by those skilled in the relevant art. The various principal aspects can optionally be provided in combination with one or more of the optional features described in relation to the other principal aspects. Furthermore, optional features described in relation to one example (or embodiment) can optionally be combined alone or together with other features in different examples or embodiments.

BRIEF DESCRIPTION OF THE DRAWINGS

Further features of the present invention are more fully described in the following description of a non-limiting embodiment. This description is included solely for the purposes of exemplifying the present invention. It should not be understood as a restriction on the broad summary, disclosure or description of the invention as set out above. The description will be made with reference to the accompanying drawings in which.

In the Figures, like structures are referred to by like numerals throughout the views provided. The drawings shown in the Figures are not necessarily to scale, with emphasis instead generally being placed upon illustrating the principles of the present invention as exemplified in the embodiments described.

DESCRIPTION OF EMBODIMENTS

The present invention is not to be limited in scope by any specific embodiment described herein. The embodiments described are intended for the purpose of exemplification only. Functionally equivalent products, and methods are clearly within the scope of the invention as described herein.

Embodiments of the invention described herein may include one or more range of values (eg. size, displacement and field strength etc). A range of values will be understood to include all values within the range, including the values defining the range, and values adjacent to the range which lead to the same or substantially the same outcome as the values immediately adjacent to that value which defines the boundary to the range.

Other definitions for selected terms used herein may be found within the detailed description of the invention and apply throughout. Unless otherwise defined, all other scientific and technical terms used herein have the same meaning as commonly understood to one of ordinary skill in the art to which the invention relates.

Figure 1:
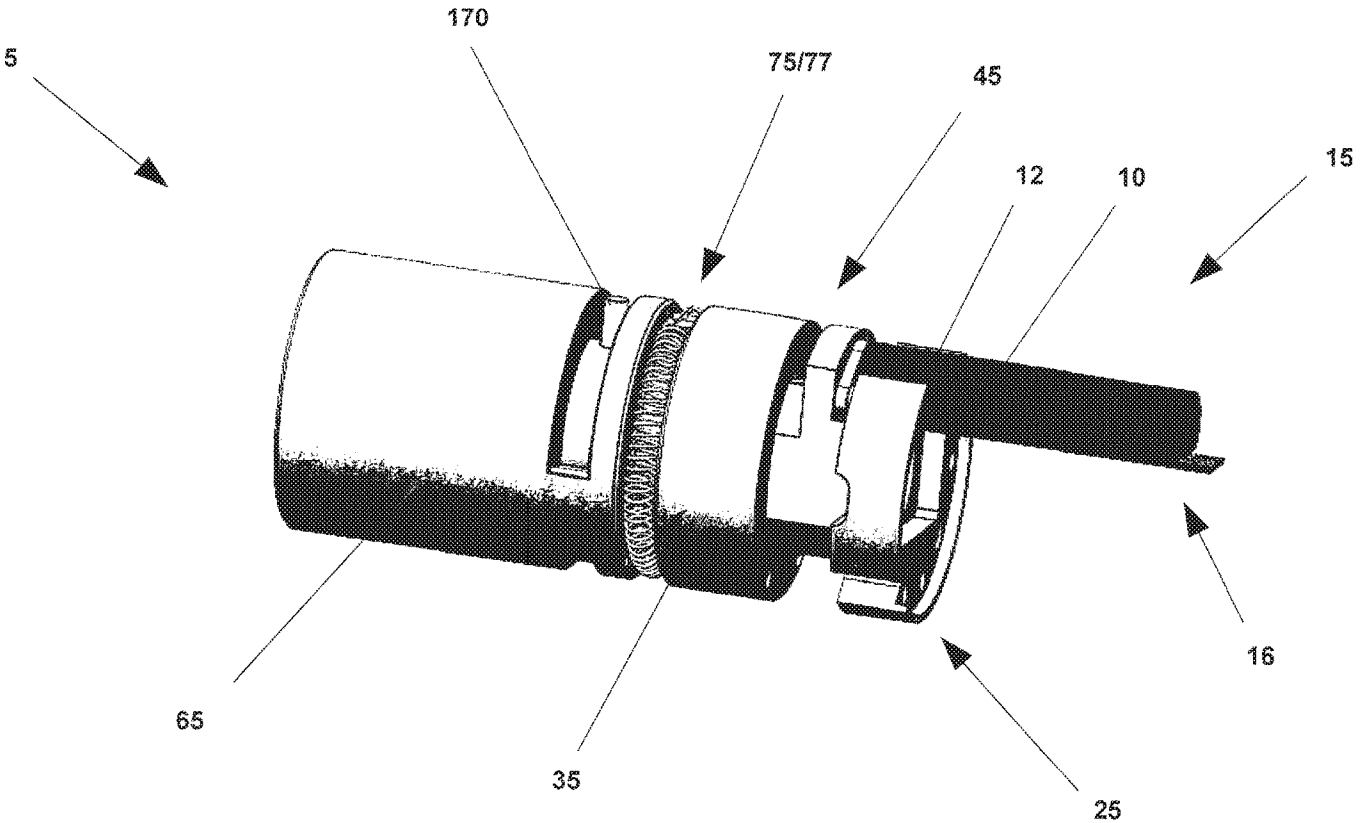
FIG. 1 is a perspective view of one embodiment of an apparatus arranged for indexing a sensor used in a down hole surveying apparatus.
Figure 2:
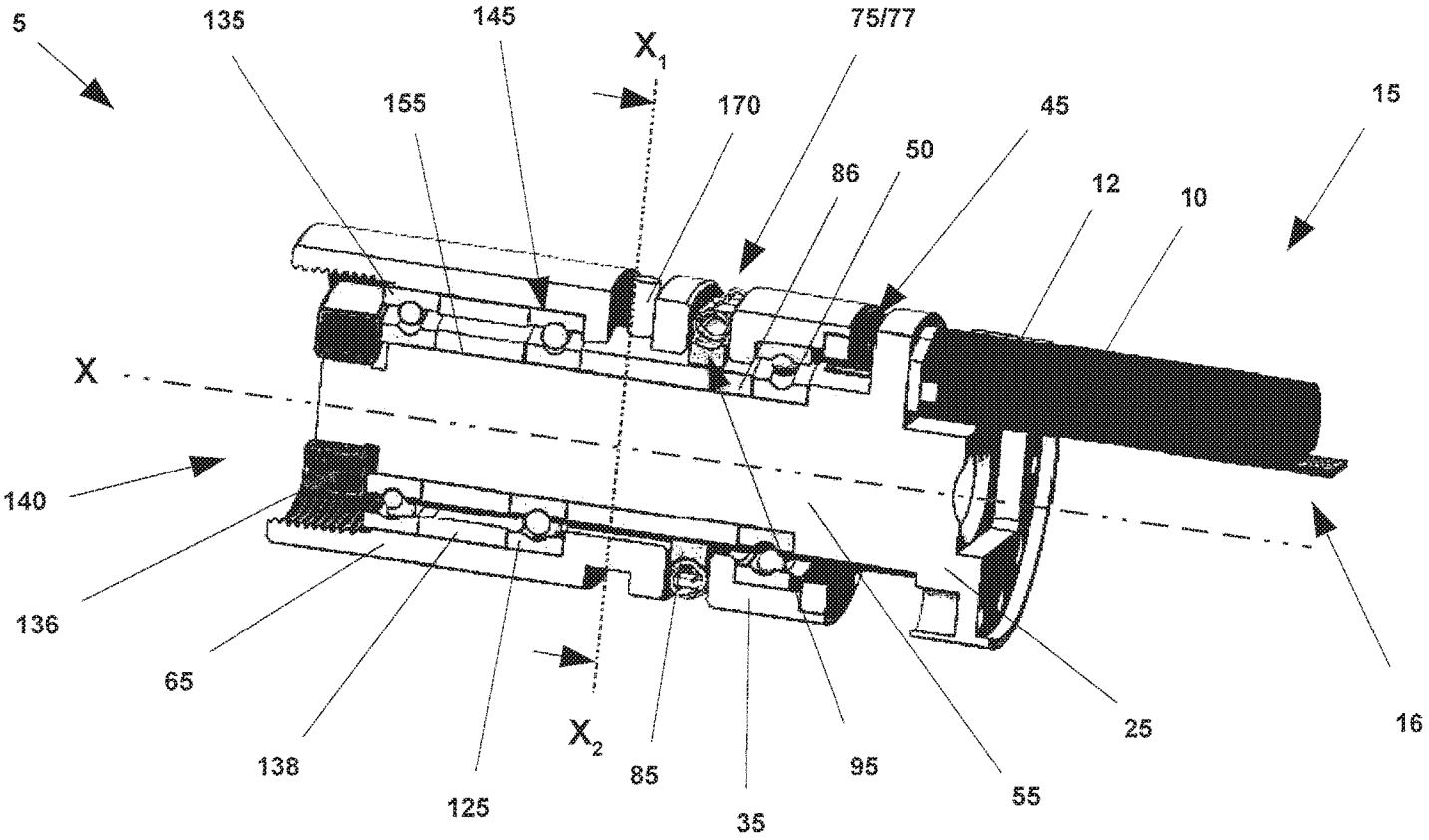
FIG. 2 is another perspective view of the embodiment of the apparatus shown in FIG. 1, when sectioned along the axis X.

FIGS. 1 to 6 show one embodiment of an apparatus 5 arranged for indexing a device configured for carrying a sensor (such as for example a gyroscope (not shown)) between two index positions about an indexing axis X (shown in FIG. 2).

The apparatus 5 comprises an indexing drive mechanism 15 having a motor unit 10 and gearbox arrangement 12 configured for providing drive to a driven portion which is provided in the form of a first collar 35. Drive is provided to the first collar 35 by way of a mating pinion and a ring gear set assembly 45. The indexing mechanism 15 also includes an encoder assembly 16.

The apparatus 5 also includes a body provided in the form of a chassis 25, which is configured to support the motor 10, gearbox arrangement 12, and encoder assembly 16. The chassis 25 has a longitudinal axis which is aligned substantially concentric with the indexing axis X. The first collar 35 is arranged relative a region of the chassis 25 so that it may rotate thereabout by drive provided by the motor 10 and gearbox arrangement 12. As shown in FIGS. 1 and 2, the motor 10, gearbox arrangement 12 and encoder 16 assembly are arranged so as to be supported by the chassis 25 in an off-axis manner relative to the longitudinal axis of the chassis 25 so that the motor drive can engage with the ring gear set assembly 45. In this regard, FIG. 5 and FIG. 6 each serve to show the operable association of the annular ring gear 47 with the pinion 48 driven by motor 10 by way of gearbox 12.

The sensor carrying device is provided in the form of a second collar 65 which is operably associated with the first collar 35 in a manner which seeks to substantially reduce the susceptibility of the second collar 65 (and the sensor(s) it carries) becoming subject to any undesirable physical forces which might result while the sensor is operable in a measurement process: when provided at one of the index positions, during indexing of the second collar 65 about the indexing axis X to one of the index positions, and/or when in a 'parked' position (generally in a region between the index positions).

Undesirable or adverse external/system forces may include, but need not be limited to, any adverse vibrational and/or shock forces to which the second collar 65 may become subject to during the course of operation (eg. measurement being undertaken by one or more sensors carried by the second collar 65 when at either index position and/or during indexing about the index axis X). Vibration forces may include induced physical movement/forces resulting from prime movers such as, for example, electric motors. As one example, servo or stepper motors are usually driven by a chopped drive current to allow accurate control of their speed and position. In such instances, the chopped current can cause small vibrations of the motor shaft even when stationary. Thus, if such a motor is directly coupled to a sensor carrying device such as the second collar 65 which is used to drive the sensor to a desired index position, when held at that position the residual vibrations of the motor drive shaft can be transferred to the sensor carrying device causing unwanted sensor 'noise' when the sensor is performing a measuring operation. As the skilled reader will appreciate, it is important that the sensor (eg. gyroscope) remains substantially stationary during measurement.

Shock forces may include various external forces applied to the apparatus 5 during its movement into, within, and/or out of the target drilled borehole for measurement purposes. In some instances, shock forces may be less of a threat to the operation of the sensor carrying device (collar 65) during indexing so long as the motion of the drive motor is smooth.

Figure 3:
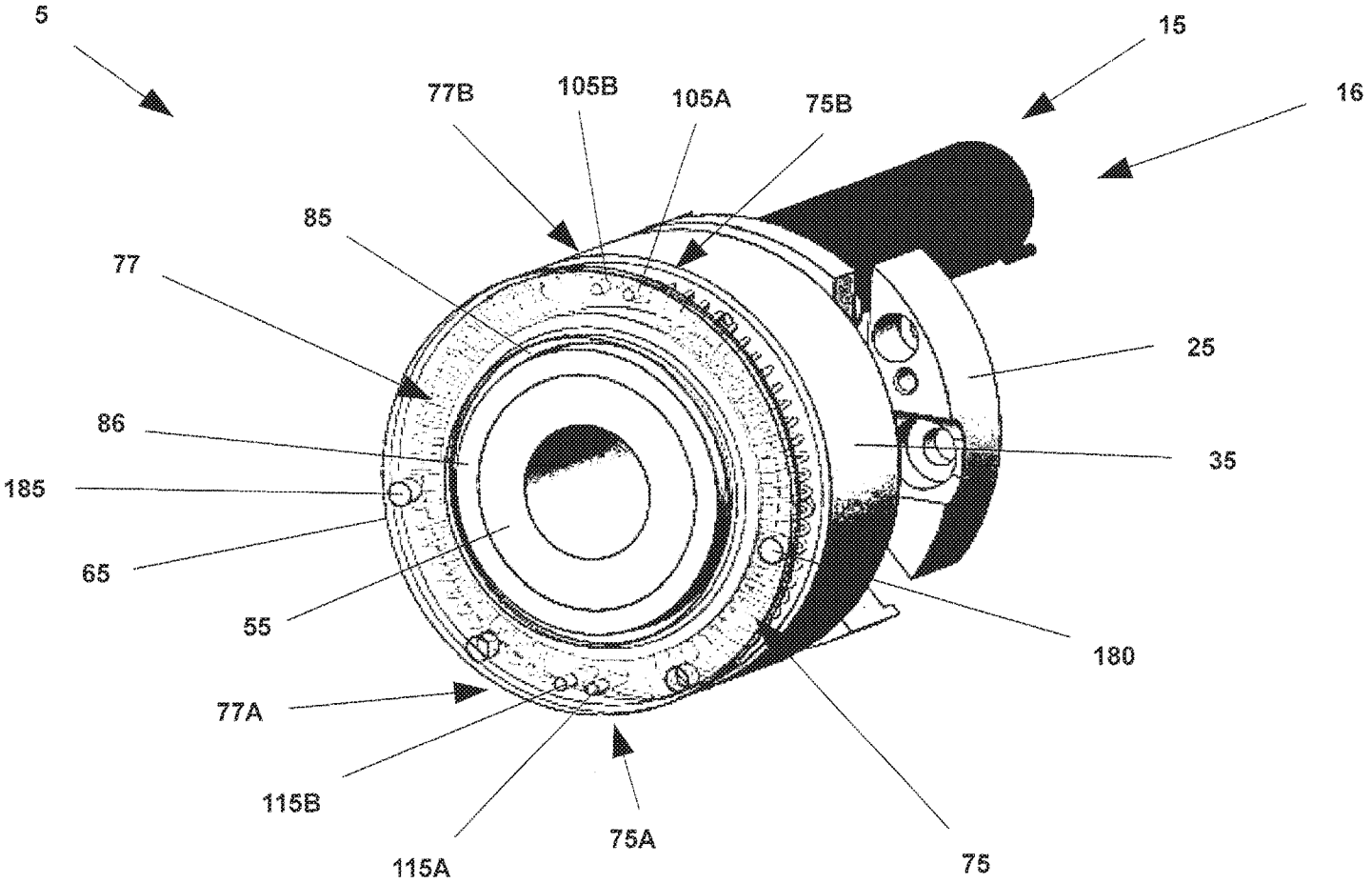
FIG. 3 is a further perspective view of the embodiment of the apparatus shown in FIG. 1 and FIG. 2, having a collar removed.

The first collar 35 is arranged so as to freely rotate about a region of the chassis 25 by way of a ball race assembly 50 (see FIG. 2) mounted between the first collar 35 and an elongate portion 55 (see FIG. 2) of the chassis 25. The first collar 35 is arranged concentric with the second collar 65 about the indexing axis X and coupled together by way of an assembly of a pair of coil springs 75, 77. As shown in FIG. 3, coil springs 75, 77 are arranged opposite one another at the outer periphery of a support element 85, which is provided between the first 35 and the second 65 collars. The support element 85 sits about a spacer 86, which in turn is provided about a region of the elongate portion 55. A grooved region 95 is provided within the support element 85 at its periphery and serves to, at least in part, accommodate the coil springs 75, 77.

The first collar 35 includes a pair of pins 105A, 105B provided near its periphery at one of its ends as shown in at least FIG. 3. Similarly, the second collar 65 includes a pair of pins 115A, 115B provided near its periphery at one of its ends as shown. Pins 105A, 105B and 115A, 115B extend outward from the first 35 and the second 65 collars respectively and are arranged substantially symmetrical about the indexing axis X (or so as to oppose one another about the axis X as shown in the Figures).

The coupling between the first 35 and the second 65 collars is achieved by a first end 75A of the coil spring 75 attaching to pin 115A of the second collar 65, and a second end 75B of the spring 75 attaching to pin 105A of the first collar 35. Similarly, a first end 77A of the spring 77 attaches to pin 115B of the second collar 65, and a second end 77B of spring 77 attaches to pin 105B of the first collar 35.

As shown in the Figures, the coil springs 75, 77 are arranged about opposite sides of the support element 85 seated on spacer 86. In this manner, either coil spring 75, 77 is operably responsive (operable so as to be extensible) when acted upon by the first collar 35 when driven by motor 10 about the axis X. When either spring 75, 77 is extended by movement of the first collar 35, its resilient nature serves to revert it towards its original or unextended state thereby causing a biasing force which biases the second collar 65 toward and in response to movement of the first collar 35.

The second collar 65 is capable of freely rotating about the elongate portion 55 of the chassis 25 by way of a pair of ball race bearing assemblies 125, 135 provided between the inner surface 145 of the second collar 65 and the outer surface 155 of elongate portion 55 of chassis 25. The ball race bearing assemblies 125, 135 are retained in position by a retainer 136 which threadingly engages with a threaded portion provided at an end 140 of the elongate portion 55 (of the chassis 25). Ball race bearing assemblies 125, 135 are separated by a spacer 138 arranged about the elongate portion 55. All ball race bearing assemblies may be provided, for example, in the form of Timken Torque Tube 1219 bearing assemblies. It will be appreciated that other makes and sizes of bearing assemblies would be satisfactory or could be adapted/configured to work with different embodiments of the apparatus 5.

In the presently described embodiment, the second collar 65 is configured so as to carry a sensor, such as for example a gyroscope. However, in an alternate arrangement (discussed below), the sensor (or other like sensor) can be arranged so as to be associated with or carried by the chassis 25. The skilled reader will appreciate that the sensor may be a device of any appropriate type; for example, the sensor device may comprise one or more of the following: accelerometers, gyroscopes, physical switches, magnetometers, vibration sensors, inclinometers, inductive RPM sensors, flow sensors and pressure sensors, or any suitable combination. The latter examples are not to be taken as being an exhaustive list as the skilled reader would readily appreciate the scope of sensors which could find utility in application with the subject apparatus.

In operation, torque applied by way of the motor 10 provided with the encoder assembly 16 to the first collar 35 is transferred to the second collar 65 due to the bias force resulting from the extension of one of the coil springs 75, 77 (and the corresponding reduction of extension of the alternate or opposing coil spring). In this manner, the second collar 65, and the sensor (eg. gyroscope) carried thereby, can be rotated using motor 10 until one of two limit pins, 180, 185 is brought into engagement with a mechanical stop provided in fixed relationship with the chassis 25 in the form of pin 170. Limit pins 180, 185 are embedded in collar 65 and define two indexing positions/limits and are typically positioned to allow the second collar 65 a range of rotational movement of about 180 degrees of travel.

Thus, the coil springs 75, 77 couple the first collar 35 and the second collar 65 in such a way so that each coil spring is provided substantially symmetrical about the elongate portion 55. In this manner, the first collar 35 and the second collar 65 are coupled together in an arrangement which allows for the second collar 65 to follow the movement of the first collar 35, regardless of the direction the first collar 35 is moved.

As the skilled reader will readily appreciate, movement of the first collar 35 serves to place one of the coil springs 75,77 into a state of bias whereby the response (due to its resilient nature) of the relevant coil spring is to bias the second collar 65 to follow the movement of the first collar 35. Thus, movement of the first collar 35 has the effect of the extending the relevant coil spring 75, 77 (or modifying its shape from its original form) which, due to its resilient nature, seeks to revert toward its original or steady state condition. Thus, continual movement of the first collar 35 (assuming no limit position is provided) will continue to bias the second collar 65 so as to follow the movement of the first collar 35 when driven. It will be appreciated that substantially the same physical response occurs for both coil springs 75, 77 when either are placed into a state of bias—which will of course depend upon which index position the second collar 65 is to be biased toward. It follows that the alternate coil spring (75, 77) (that not extended) offers less of a biasing influence to the second collar 65 when following the movement of the first collar 35.

During an indexing operation in which the second collar 65 is being moved to one of the index positions, once one of limit pins (180, 185) engages with pin 170, therefore confirming that an index position has been reached; additional driving of the first collar 35 (by way of the motor 10) increases the extension of one of the springs 75, 77. This additional driving of the first collar 35 serves to provide a biasing force for holding the second collar 65 (by way of whichever limit pin 180, 185 is relevant) against the pin 170. Once the required biasing or holding force is achieved, power to the motor 10 can be removed and/or the motor's electrical connections shorted together to provide an electromechanical braking effect. In this manner, operation of the motor 10 ceases allowing the sensor carried by the second collar 65 to operate (for measurement/recording purposes) in an environment which is substantially free from any undesirable vibrational/shock forces which might occur due to standard operation of the motor.

The first collar 35 may be configured controllable so that it decelerates to a lower speed as the second collar 65 approaches a desired limit position so as to substantially reduce or minimise any shock force as the limit position is reached (ie. when engagement between either of pins 180, 185 with limit pin 170 occurs). Thereafter, the motor 10 can be arranged to accelerate again so as to provide the additional drive to the first collar 35 in order to stretch or extend the relevant coil spring (75, 77) so as to apply the holding force for biasing either of the pins 180, 185 of the second collar 65 against the limit pin 170.

As will be apparent, the coil springs 75, 77 coupling the first 35 and second 65 collars are arranged in an a symmetrical relationship about the elongate portion 55 providing a substantially cooperative arrangement which, at least in part, serves to dampen or reduce any undesirable vibration and/or shock forces which might be imparted to the second collar 65 and any sensor carried thereby during any measurement and/or indexing operation. Furthermore, such arrangements may also serve to reduce the transfer of any torque impulses to the second collar 65 or elongate portion 55 when drive is provided to the first collar 35.

Figure 4:
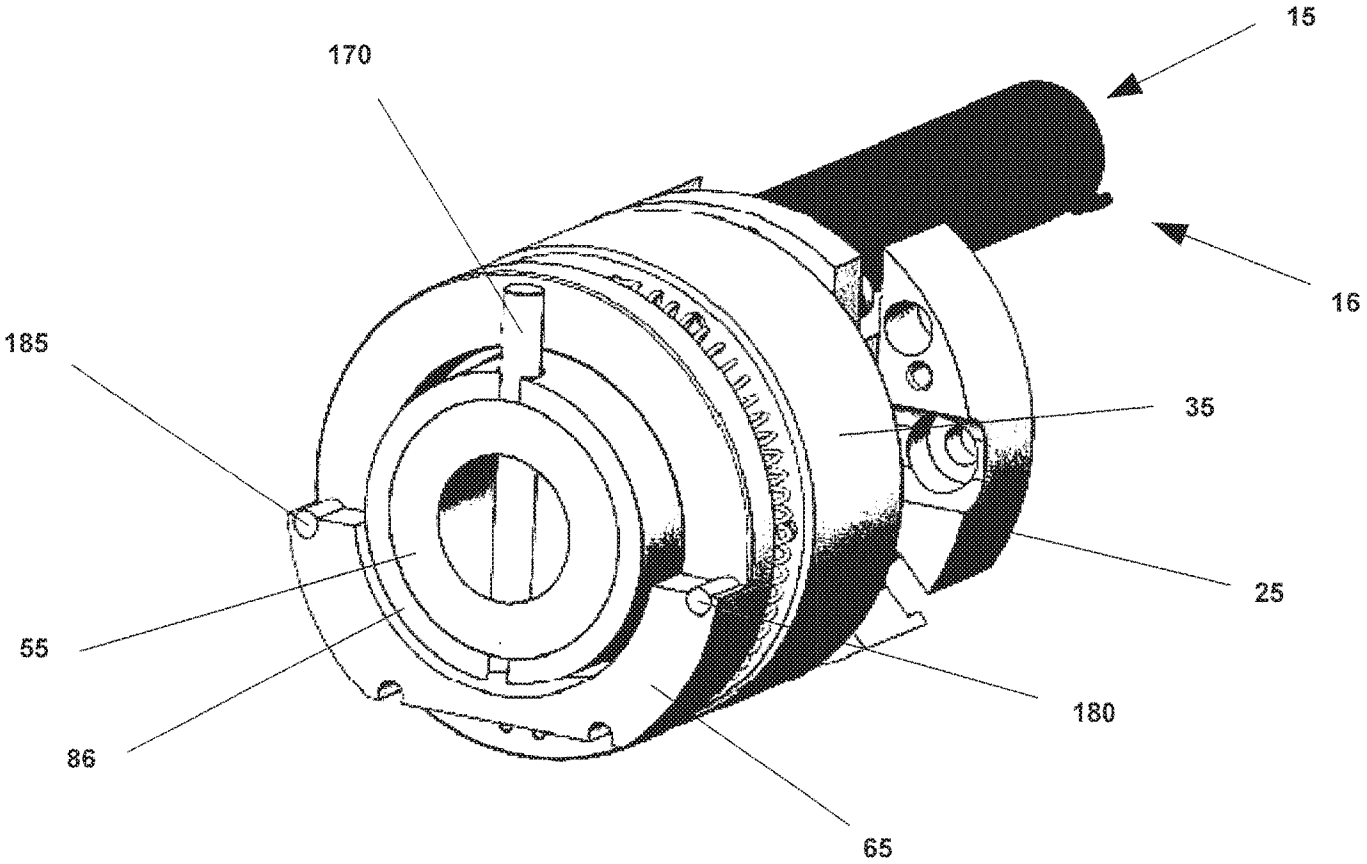
FIG. 4 is a perspective view of a cross section $X_1$-$X_2$ (see FIG. 2) of the embodiment of the apparatus shown in FIGS. 1 to 3.
Figure 5:
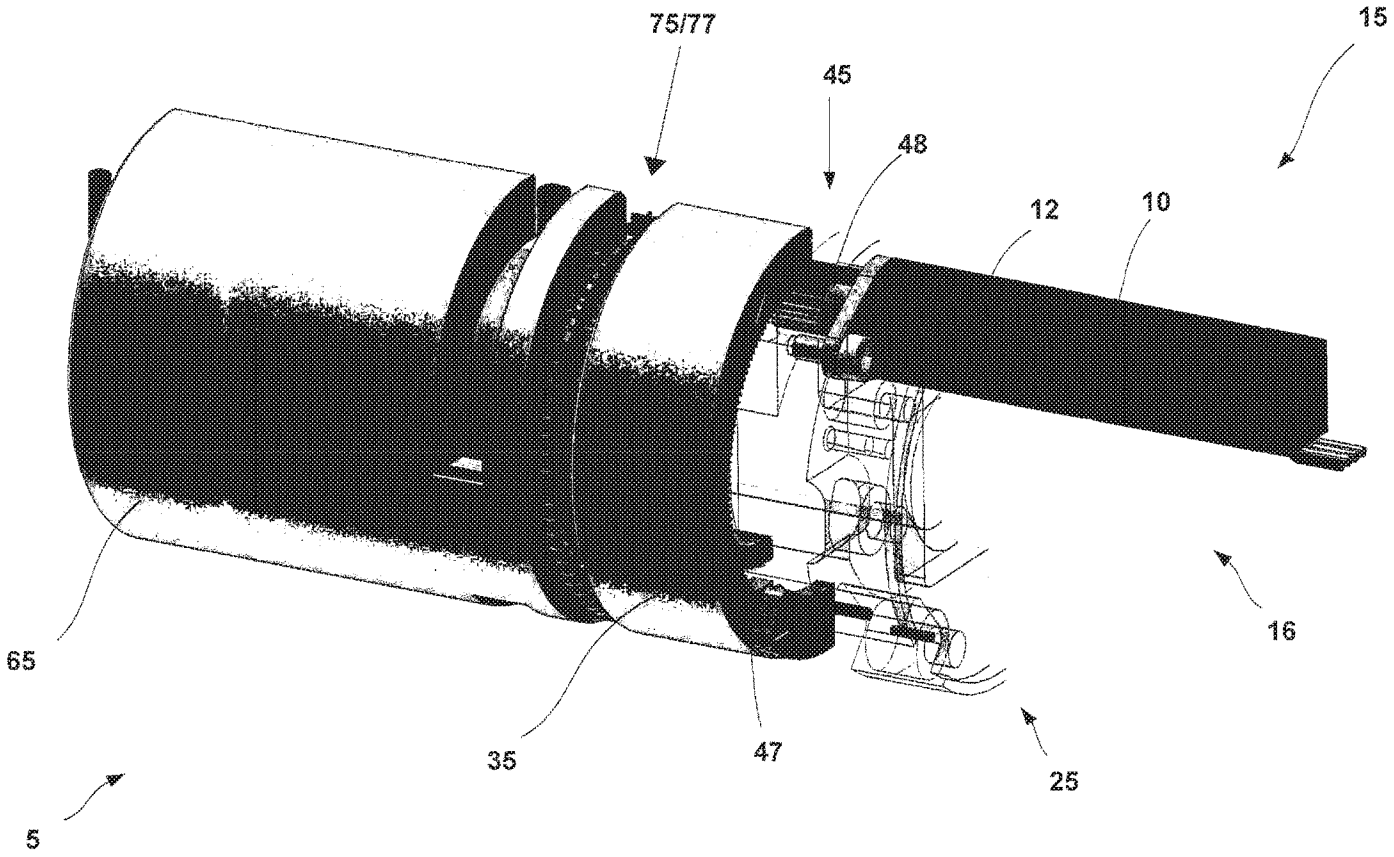
FIG. 5 is a perspective view of one side of the embodiment of the apparatus shown in FIGS. 1 to 4, with attention focused on the ring gear set assembly.
Figure 6:
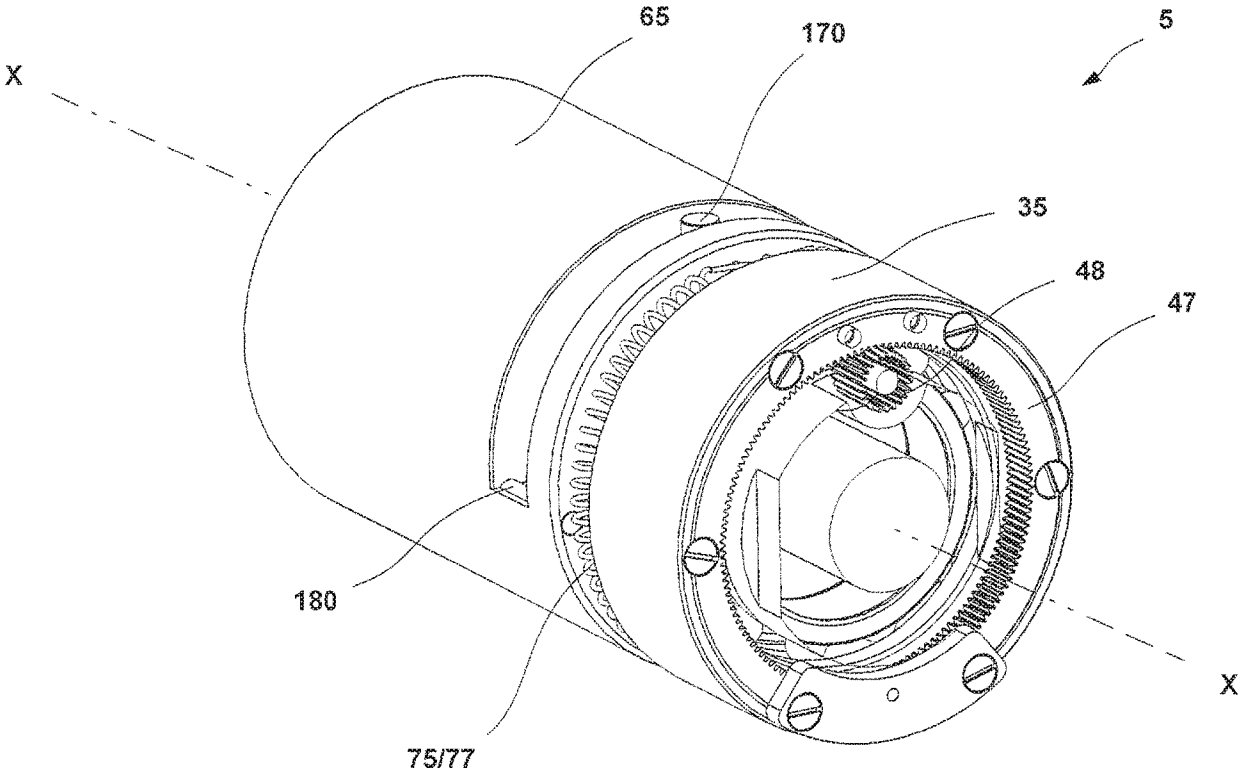
FIG. 6 shows a further perspective view of that shown in FIG. 5 with the chassis hidden.

At times when the sensor carried by the second collar 65 is not required to be held at either indexing position, the second collar 65 can be driven to an intermediate or park position (shown in FIG. 4). As discussed below, when in this position, operation of the coil springs 75, 77 in the configuration shown, at least in part, affords protection to the sensor/gyroscope against undesirable vibrational and/or shock forces (eg. torque impulses).

The resilient association between the first 35 and second 65 collars by way of the dual coil spring (75, 77) coupling causes the collar 65 to follow movement of the collar 35. In one respect, this resilient association is operable so that the second collar 65 maintains or seeks to maintain a predetermined alignment with the first collar 35 during indexing of collar 65 about the indexing axis X. The coil springs 75, 77 can be arranged so that both are balanced such that substantially little or no net force is applied to the second collar 65. In this balanced state, the second collar 65 and the first collar 35 are aligned with one another in an equilibrium like condition at the desired or predetermined alignment (between collars 35, 65). Thus, the second collar 65 and the first collar 35 are arranged relative one another in a manner which defines a desired or predetermined state of alignment between both components. For the embodiment of the apparatus 5 described, this alignment between both components is substantially intermediate the index positions, but could be arranged so as to be biased toward either if required.

In operation, movement of the first collar 35 causes the second collar 65 to follow therewith in an effort to maintain or seek the steady state alignment. Due to the resilient nature of each coil spring 75, 77, the second collar 65 is unlikely to cease movement at the instant the first collar 35 ceases movement. Instead, although the biasing force applied to the second collar 65 by the relevant coil spring 75, 77 substantially reduces, the collar 65 is likely to overrun the stop position of the collar 35 due to the acquired rotational inertia. Once the second collar 65 overruns the stop position of the collar 35, a biasing response is provoked from the alternate coil spring 75, 77 which then serves to bias the collar 65 toward the stop position of the collar 35.

It will be appreciated that, depending on the dynamic circumstances surrounding the cessation of the movement of the first collar 35, and the degree of resilience of the coil springs 75, 77, the second collar 65 might oscillate about the equilibrium state a number of times until a steady or balanced state between both coil springs 75, 77 is reached. Thus, until the balanced state is reached, both coil springs 75, 77 could transition through varying degrees of bias until the steady state condition is attained.

Having specific regard to the form of coil springs 75, 77, one test embodiment has shown that favourable performance can be achieved if coil springs 75, 77 are extended to approximately 50% of their maximum extension when the collars 35, 65 are in a rest or balanced state (when alignment as desired). Thus, both springs 75, 77 are initially provided in a preloaded equilibrium. In this configuration, a sufficiently responsive coupling arrangement has been found to be provided—for example, as one spring stretches the alternate spring retracts or relaxes. The arrangement of the coil springs 75, 77 is such that the coils of the retracted or retracting coil spring never close up completely so as to cause the coil spring to bulge outward from the apparatus 5. It will be appreciated that the rest state as referred to here may be the desired or predetermined steady state alignment between the first 35 and second 65 collars. As noted, the desired or steady alignment between the first 35 and second 65 collars could be one that is biased toward either limit/index position.

A range of spring constants within the allowable space have been tested and found to be not substantially critical so long as the desired holding force—that which holds either of the pins 180, 185 against the limit pin 170—can be achieved with an acceptable amount of additional motor drive.

The above described arrange represents, broadly, a first implementation of operation in which the chassis 25 is arranged stationary relative to the indexing axis X. However, other embodiments of the apparatus 5 (ie. the second implementation embodiments described above) can be realized in which the chassis 25 is provided with freedom to rotate about the indexing axis X, and the collar 65 is arranged to be fixed or stationary relative to the indexing axis (which will often be, for example, by way of rigid connection with a housing or similar of a down hole survey instrument or survey tool). In such arrangements, the chassis 25 is arranged to carry a sensor device/arrangement in a similar manner to that of collar 65. In arrangements of this nature, it will be understood that the same relative movements as described above are applicable and thus many of the structural, operational, and conceptual features previously described continue to apply to the case where the chassis 25 rotates about the indexing axis X, and second collar 65 is fixed relative to the indexing axis X.

In operation of such arrangements, movement of the chassis 25 remains by way of drive provided by the indexing drive mechanism 15 as discussed above. In this regard, the structural relationship of the chassis 25 and the indexing mechanism 15 is the substantially same. As the reader will appreciate, in embodiments where second collar 65 is held fixed relative to the indexing axis X, drive provided by the indexing mechanism 15 to the collar 35 serves to cause relative movement there between. With the second collar 65 stationary relative to the indexing axis X and the association between the first collar 35 and the collar 65 sufficiently resilient, drive provided by the indexing mechanism 15 to drive collar 35 serves to rotate the chassis 25 about the indexing axis X. In this manner, it is the pin 170 that moves about the indexing axis X to or toward a stationary limit pin 185/180 (depending of course on which of the index positions the chassis 25 is to be moved to or toward), as opposed to, in the first implementation described above, the limit pins 180/185 in collar 65 being rotated to engage the pin 170.

Movement of the chassis 25 about the indexing axis X will continue until the pin 170 is brought into engagement with one of the limit pins 180/185. Once this engagement occurs, further driving of the collar 35 serves to test the resilience of the association between the collar 65 and the collar 35. Further driving of the collar 35 begins to rotate the collar 35 about the indexing axis X. As such, the association between the collar 35 and the collar 65 serves to bias or urge the chassis 25 (by way of pin 170) against a limit pin 180/185 of a respective limit position. In this manner, the chassis 25 is effectively held (biased or urged) against the limit pin (180/185) of the corresponding intended index position.

As noted above, the motor unit 10 can be configured (in the manner described above) to be electrically shorted so as to brake the motor and maintain the biased state. In this state, when the association between the collar 35 and the collar 65 is resilient in nature, exposure of any undesirable forces to any sensor carried on the chassis is, at least in part, reduced. Similarly, when driving toward an intended limit position, the indexing mechanism can be configured so as to control the speed of the approach to the limit position such the shock of any contact with the pin 170 is reduced, before then returning to an appropriate speed to cause collar 35 to rotate beyond the index position so that the necessary biasing/holding force can be applied (as described above).

As described above, the indexing mechanism 15 may be operable to drive the chassis 25 to a position which is substantially intermediate the index positions —such as a 'park' position. In this manner, the association between the collar 35 and the collar 65 is configured such that exposure of the chassis 25 (and the sensor(s) carried thereby) to any undesirable forces is, at least in part, reduced.

Those skilled in the art will appreciate that the invention described herein is susceptible to variations and modifications other than those specifically described. The invention includes all such variations and modifications. The invention also includes all of the steps, and features referred to or indicated in the specification, individually or collectively and any and all combinations or any two or more of the steps or features.

The skilled reader will appreciate that coil springs 75, 77 could be readily replaced by any suitable coupling means of resilient character capable of being deformable in some manner so that it can store energy therein. For example, any type of flexible coupling element made from rubber, silicone, or polymer, could be configured for suitable use. It will be appreciated that arrangements using gas or pneumatic coupling assemblies having sufficient resilient character could be configured for use.

Other configurations which couple first 35 and second 65 collars together in a resilient like manner will be possible. In one alternative embodiment, the coil springs 75, 77 could be replaced by a single piece sleeve formed from a resilient material (such as, for example, rubber) and arranged so as to couple the first 35 and second 65 collars together at opposing ends at or near their peripheries. As with the above described operation, biasing of the second collar 65 so as to follow the movement of the first collar 35 (or vice versa) occurs due to the extensible and resilient nature of the sleeve. In at least one embodiment, one or more portions or regions of the sleeve would serve to provide the biasing effect when extended by movement of the first collar 35.

Any method for operating embodiments of the apparatus 5 may broadly involve providing an embodiment of apparatus 5 and associating it with a down hole surveying tool or surveying instrument so that the apparatus is operable therewith, and causing or operating the apparatus to drive the sensor carrying device (either collar 65 or chassis 25 depending on which implementation is relevant) about the indexing axis X to, toward, or from an index position.

When the sensor is at the intended index position, the apparatus may be caused or operated to hold the device at the index position for a predetermined period of time for measurement purposes before driving the device toward another index position for about the same predetermined period of time for measurement purposes.

As discussed above, the apparatus 5 may be caused or operated so as to reduce the speed of driving the device about the indexing axis X as the device approaches the intended index position. This is so as to reduce any impact forces as the limit pins 180/185 engage with the pin 170. Furthermore, the speed of driving the device about the indexing axis may be increased in the direction of the intended index position once the device has reached the index position. In this manner, further driving of the collar 35 rotates the collar about the indexing axis X. As such, the association between the collar 35 and the collar 65 is arranged so as to bias or urge the chassis 25 at a respective limit position. In this manner, the chassis 25 is effectively held (biased or urged) against the limit pin (180/185) in the intended index position.

In another embodiment, any operative method may comprise driving the device between a first index position and a second index position in a consecutive manner during the course of a survey operation.

When the sensor carried by the device (collar 65 or chassis 25) is not operable, the apparatus may be caused or operated to drive the device to a park or inactive position. In this manner, the resilient nature of the coupling between collar 35 and collar 65 serves to, at least in part, limit exposure of the sensor to any undesirable physical forces when the device is in the 'park' or inactive position.

It will be appreciated that survey devices or instruments incorporating embodiments of apparatus 5 will comprise a plurality of components, subsystems and/or modules operably coupled via appropriate circuitry and connections to enable the apparatus 5 to perform the functions and operations herein described. This will include suitable components, such as computing means having associated storage, necessary to receive, store and execute appropriate computer instructions such as a method of performing a down hole surveying operation using a survey instrument in accordance with an embodiment of the invention. This will include sufficient electronics for measuring various types of information and recording such information (for example, recording data to one or more appropriate memory modules) for subsequent processing. Further, such electronics will also include suitable controllers programmed to carry out any such measuring, recording, and/or processing of information as might be required.

As the skilled person will appreciate gyroscopes such as dynamically tuned gyroscopes (DTGs) based on north seeking survey instruments will typically need to index the gyroscope between two measurement positions in order to allow any static bias errors to be reduced or eliminated.

Gyroscopic data acquisition in each measurement position may typically take in the order of about 40 seconds, and movement from one position to the other may typically take a further (about) 10 seconds. Thus, a survey process from initiation to completion may take about 90 seconds in total, ie. consisting of about 40 seconds in the first index position, about 10 seconds traversing between the first index position and a second index position, and about 40 seconds in the second index position.

Figure 7:
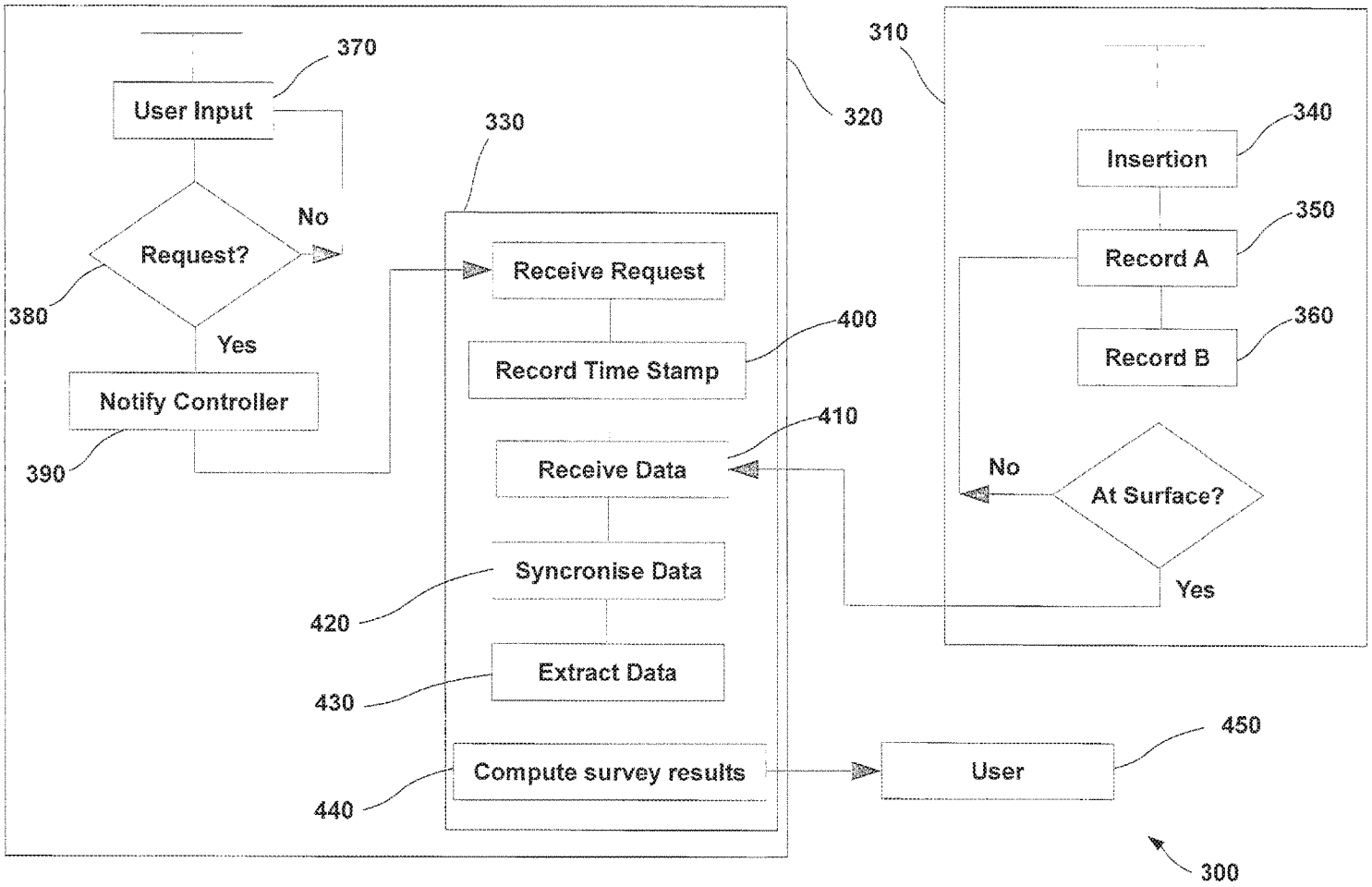
FIG. 7 is a flow diagram showing one implementation of a method of performing a down hole survey of a bore hole.

One embodiment of a method 300 proposed for conducting a survey of a borehole using a survey instrument is shown in FIG. 7. For the arrangement shown, the survey instrument is configured so as to incorporate apparatus 5 for indexing a sensor device carried by the second collar 65 between first 350 and second 360 index positions (such as for example index positions which correspond to pins 180, 185 as described above).

In broad terms, the proposed method 300 seeks to provide a convenient means of performing a down hole surveying operation comprising recording data measured from the sensor (such as for example a gyroscope) when provided at the first and second index positions. The survey instrument is arranged so as to measure the data at each index position in a continuous and consecutive manner.

The method 300 further comprises acknowledging the time the data was recorded by way of a first timer which is arranged so as to be associated with the survey instrument. In a typical arrangement, acknowledging the time the data was recorded by the survey instrument is achieved by way of associating the time the data was recorded with the corresponding recorded data (such as by recording the time the data was measured to an appropriate memory module).

The method 300 further comprises, by way of a further timer, acknowledging a point in time while the survey instrument is down hole during the surveying operation. It will be understood that such acknowledgement represents a user or operator requesting a survey report to be prepared based on the data measured down hole following the request being made. The means by which the request is made may be by way of, for example, an input into an appropriate controller 330 provided at the surface by the user/operator.

Once the survey instrument has been retrieved and is back on the surface, the method 330 further comprises identifying data recorded by the survey instrument after the request was made by the user/operator for use in preparing the survey report. This process of identifying the data recorded by the survey instrument after the request was made by the user/operator may be carried out by, for example, synchronising the controller 330 with the survey instrument so that the data stored in the survey instrument can be interrogated in an appropriate manner.

Use of the apparatus 5 in the proposed method is advantageous in that it is necessary to ensure that the data measured by one or more sensors carried by the apparatus 5 is less exposed to undesirable noise components caused, at least in part, due to physical forces resulting from vibrational/forces emanating from internal/external sources. The skilled reader will appreciate the need to ensure that the sensor remains as stationary as possible while operational for measurement purposes.

The method 300 is shown in the form of a multiple component flow chart, reflecting events occurring downhole 310 by the surveying instrument, and those occurring at the surface 320 by the controller 330.

Similarly to the apparatus 5, the controller 330 comprises a plurality of components, subsystems and/or modules operably coupled via appropriate circuitry and connections to enable the controller 330 to perform the functions and operations herein described. The controller 330 comprises suitable components necessary to receive, store and execute appropriate computer instructions such as a method of performing a down hole surveying operation using a survey instrument in accordance with at least one embodiment described herein.

Figure 8:
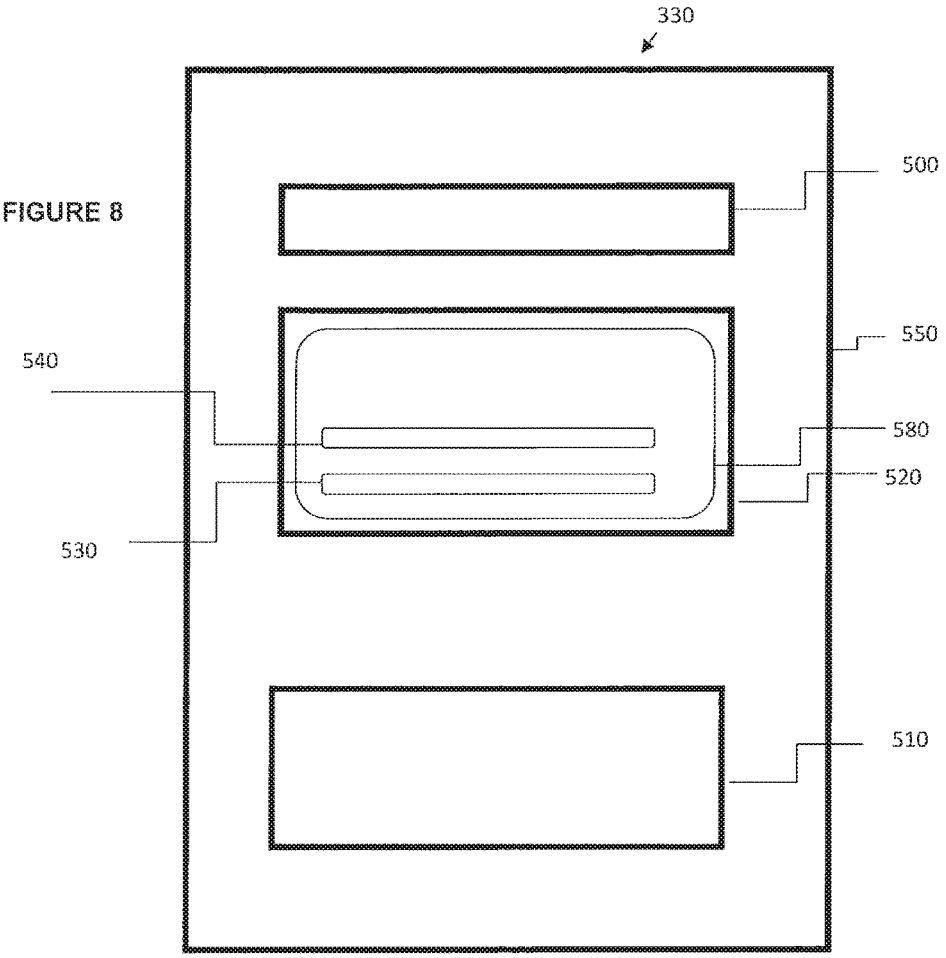
FIG. 8 depicts a schematic diagram of a controller module used in the method shown in FIG. 7.

Particularly, and as shown in FIG. 8, the controller 330 comprises computing means which in this embodiment comprises processing means in the form of a processor 500 and storage 510 for storing electronic program instructions for controlling the controller 330, and information and/or data; a display 520 for displaying a user interface 530; and input means 540; all housed within a container or housing 550, so as to provide a controller module.

The storage 510 comprises read only memory (ROM) and random access memory (RAM).

The controller 330 is capable of receiving instructions that may be held in the ROM or RAM and may be executed by the processor 500. The processor 500 is operable to perform actions under control of electronic program instructions, as will be described in further detail below, including processing/executing instructions and managing the flow of data and information through the controller 330.

In the embodiment, electronic program instructions for the controller 330 are provided via a single software application (app) or module which may be referred to as a surveying app. The surveying app can be downloaded from a website (or other suitable electronic device platform) or otherwise saved to or stored on storage 510 of the controller 330.

In some embodiments, the controller 330 comprises a smartphone such as that marketed under the trade mark IPHONE® by Apple Inc, or by other provider such as Nokia Corporation, or Samsung Group, having Android, WEBOS, Windows, or other Phone app platform. Alternatively, the controller 330 may comprise other computing means such as a personal, notebook or tablet computer such as that marketed under the trade mark IPAD® or IPOD TOUCH® by Apple Inc, or by other provider such as Hewlett-Packard Company, or Dell, Inc, for example, or other suitable processing apparatus.

The controller 330 also includes an operating system which is capable of issuing commands and is arranged to interact with the surveying app to cause the controller 330 to carry out the respective steps, functions and/or procedures in accordance with the embodiment described herein. The operating system may be appropriate for the controller 330. For example, in the case where the controller 330 comprises an IPHONE® smartphone, the operating system may be iOS.

Figure 9:
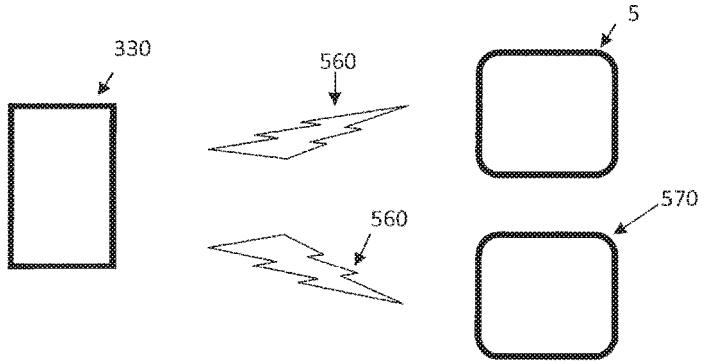
FIG. 9 depicts a simplified system diagram of a system implementing the method shown in FIG. 7.

With reference to FIG. 9, the controller 330 is operable to communicate via one or more communications link(s) 560, which may variously connect to the apparatus 5, and optionally one or more other remote devices and/or systems 570 such as servers, personal computers, terminals, wireless or handheld computing devices, landline communication devices, or mobile communication devices such as a mobile (cell) telephone. At least one of a plurality of communications link(s) may be connected to an external computing network through a telecommunications network.

The surveying app and other electronic instructions or programs for the computing components of the controller 330, and the apparatus 5, can be written in any suitable language, as are well known to persons skilled in the art. For example, for operation on a controller comprising an IPHONE® smartphone, the surveying app may be written in the Objective-C language. In some embodiments, the electronic program instructions may be provided as stand-alone application(s), as a set or plurality of applications, via a network, or added as middleware, depending on the requirements of the implementation or embodiment.

In alternative embodiments, the software may comprise one or more modules, and may be implemented in hardware. In such a case, for example, the modules may be implemented with any one or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA) and the like.

The computing means can be a device or system of any suitable type, including: a programmable logic controller (PLC); digital signal processor (DSP); microcontroller; personal, notebook or tablet computer, or dedicated servers or networked servers.

The processor can be any custom made or commercially available processor, a central processing unit (CPU), a data signal processor (DSP) or an auxiliary processor among several processors associated with the computing means. In some embodiments, the processing means may be a semiconductor based microprocessor (in the form of a microchip) or a macro processor, for example.

In some embodiments, the storage can include any one or combination of volatile memory elements (e.g., random access memory (RAM) such as dynamic random access memory (DRAM), static random access memory (SRAM)) and non-volatile memory elements (e.g., read only memory (ROM), erasable programmable read only memory (EPROM), electronically erasable programmable read only memory (EEPROM), programmable read only memory (PROM), tape, compact disc read only memory (CD-ROM), etc.). The respective storage may incorporate electronic, magnetic, optical and/or other types of storage media. Furthermore, the storage can have a distributed architecture, where various components are situated remote from one another, but can be accessed by the processing means. For example, the ROM may store various instructions, programs, software, or applications to be executed by the processing means to control the operation of the controller and the RAM may temporarily store variables or results of the operations.

The use and operation of computers using software applications is well-known to persons skilled in the art and need not be described in any further detail herein except as is relevant to the presently described embodiment.

Any suitable communication protocol can be used to facilitate connection and communication between any subsystems or components of the controller 330, any subsystems or components of the apparatus 5, and the controller 330 and apparatus 5 and other devices or systems, including wired and wireless, as are well known to persons skilled in the art and need not be described in any further detail.

In one embodiment, the display 520 for displaying the user interface and the user input means 530 are integrated in a touchscreen 580. In alternative embodiments these components may be provided as discrete elements or items.

The touchscreen 580 is operable to sense or detect the presence and location of a touch within a display area of the controller 330. Sensed "touchings" of the touchscreen 580 are inputted to the controller 330 as commands or instructions. It should be appreciated that the user input means 530 is not limited to comprising a touchscreen, and in alternative embodiments any appropriate device, system or machine for receiving input, commands or instructions and providing for controlled interaction may be used, including, for example, a keypad or keyboard, a pointing device, or composite device, and systems comprising voice activation, voice and/or thought control, and/or holographic/projected imaging.

The method 300 serves to reduce or eliminate (if possible) the need to provide a pre-set trigger for the survey process, and therefore mitigate against any need to pre-plan when the survey should take place. As the skilled reader will appreciate, traditional methods generally involve the user predicting the time at which the survey instrument will be in position, stationary and ready to commence the survey. The user would then set a time delay within the survey instrument before it is inserted into the borehole. The skilled reader will appreciate that a significant drawback with this method is that valuable rig time can be wasted if the user's initial prediction of when the survey instrument will be in position is too long, or the survey results can be useless if the user's prediction is ultimately found to be too short. The present described method seeks to avoid the need for the user or operator to make any such prediction.

With reference again to FIG. 7, once the survey instrument is inserted 340 into the borehole, the instrument is configured so as to continuously measure and record data for substantially the entire time it is down-hole 310. During this measurement process, the survey instrument is alternating or indexing between the first 350 and second 360 index positions. During the measurement process (eg. a measurement cycle), the survey instrument is sought to be held as still as possible.

Other arrangements are also possible. It will be appreciated that the survey instrument could be configured to measure continuously over a finite period of time. In one such arrangement, the survey instrument may be configured so that the finite of time period commences at a time, for example, when the operator believes or predicts that the survey instrument is likely to be in a position down hole at a location in the borehole where a survey report is required.

The survey instrument includes a timer (survey timer) which is arranged so as to be synchronised with a timer located on the surface (surface timer). In the embodiment, the surface timer is a component of the controller 330. Thus, in one arrangement, the survey instrument and the controller 330 are synchronised with one another so as to become 'initialized'—this being the process of ensuring that the survey timer and the surface timer are synchronised.

Once 'initialized', the survey instrument continuously moves the sensor from one indexing position to the other. The time spent by the sensor at each index position for measurement purposes is for a known period of time (in one embodiment, this known time period may be in the order of substantially 40 seconds). A single survey comprises two consecutive measurements taken at the two index positions.

The survey report is determined or processed using the information measured by the sensor unit(s) at each index position (350, 360) consecutively. In some configurations, preparation of the survey report is based on a preselected reference index position. In one arrangement, one of the index positions is selected to serve as the reference index position, eg. the first 350 index position. Arrangements of this type will require, for example, a survey report to be prepared using data taken from the first 350 index position, followed by data taken from the second 360 index position consecutively. In these embodiments, it will be understood that the sensor requires indexing back to the reference or first 350 index position before another survey report can be sought/prepared.

For the example outlined above for the case where the sensor comprises a gyroscope, gyroscopic data acquisition in each measurement position may typically take in the order of about 40 seconds, and movement from one position to the other may typically take a further 10 seconds. Thus, a survey process from initiation to completion may take about 90 seconds in total, ie. consisting of about 40 seconds in the first index position, about 10 seconds traversing between the first index position and a second index position, and about 40 seconds in the second index position. In such arrangements, a new survey may commence on a substantially regular basis (for example, every two minutes). In this manner, the survey start or commencement times can be readily determined; for example, for the present case where the survey commences substantially every two minutes, the relevant survey commencement times will be in two minute intervals (eg. 0-2-4-6-8 minutes (etc)) after initialization.

Other configurations might also be realised. In another embodiment, the preparation of the survey report can be configured so as to consider consecutive sets of measured data regardless of any stipulation for a reference index position. In such embodiments, a fresh survey report can be prepared using measurement data taken from either index (350, 360) position provided that the following set of measured data is taken from the alternate index position in a consecutive manner—both sets of measurement data will then be used to prepare the survey report. Thus, in arrangements of this nature, a new survey report can be prepared by not requiring the sensor to be indexed back to a required reference index position.

As the skilled reader will appreciate, arrangements of this nature can be advantageous in that a valid survey result can be prepared independent of what survey measurement (ie. survey measurement data taken from either the first or second index positions) was used as the reference index position for the survey (ie. as compared with the need to move the sensor back to the same index position in other embodiments described above). Accordingly, using the time periods outlined above, a new survey report can be commenced at approximately minute intervals.

Using the present method, at the surface 320, if at any time the operator/user wishes to record or request 380 a survey start time (for example, by pressing a button 390 provided on the touchscreen 580 to record 400 the relevant timestamp in the controller 330), the controller 330 will, in response, commence the surface timer that is configured so as to finish after the next full survey (for example, once two consecutive measurements have been taken) is expected to be completed. The survey instrument may not be moved during this period. The operator/user will generally only wish to request a survey if the survey instrument is thought to be in a stationary position.

However, the survey instruction could also be configured so that actuation of a survey is triggered by one of the sensors sensing the current state of the survey instrument when down hole. The occurrence of any current state of the survey instrument (and/or change in current state when down hole) could be detected by way of any signal(s) received from any of the on-board sensors.

For example, rather than continuously commencing a measurement cycle at pre-defined time intervals (as described above), the survey instrument could be configured to employ its on-board sensor unit(s) to make a determination as to whether the survey instrument is stationary. Such a determination could be made, for example, by the survey instrument seeking to determine whether it has remained substantially stationary (or has remained sufficiently stationary according to defined criteria) for a specified period of time during which signals from one or more sensor units associated with the survey instrument are monitored (monitoring period). Such a monitoring period may be in the order of, for example, 10 seconds, but could be any appropriate nominated time period considered sufficient for making such a determination. It would be appreciated that various practical factors could inform the quantum of such a time period, such as for example, power consumption considerations, the type of sensor being relied upon, and/or the geologic nature of the site sought to be surveyed.

The survey instrument could be configured so as to monitor signals from an accelerometer unit with the signals being processed in a manner which provides an indication of physical vibration experienced by the survey instrument when the accelerometer unit is operational during the monitoring period. If, for example, a measured signal is considered to be indicative of a stationary state during the monitoring period, the determination is made that the survey instrument is stationary and a measurement cycle can commence.

If, however, a measured signal is considered to reflect a non-stationary state, the survey instrument may be configured so that a measurement cycle is unable to commence. In such cases, the survey instrument may be configured so as to recommence the monitoring period (either automatically or at a specified future time therefrom).

If the determination is made that the instrument is stationary, and a measurement cycle is commenced, the survey instrument may be configured to continue testing or monitoring for a change in its state for the remainder of the current measurement cycle. If, for example, the state of the survey instrument were to change from being stationary to non-stationary, then the survey instrument could be configured to cease recording data and the monitoring period recommenced. Alternatively, the survey instrument could be configured to continue measuring for the remainder of the current measurement cycle and any measurement data recorded during this time associated with an appropriate indicator indicating that the data may be compromised. The data could, however, simply be deleted or discarded in an appropriate manner.

The survey instrument may be configured so that any adverse change in its state detected during a measurement cycle and/or the monitoring period has the effect of restarting the monitoring period. Any data recorded can either be discarded/deleted or retained with an appropriate caveat.

Once the survey instrument has been retrieved and the survey data open to interrogation, the controller 330 is arranged so as to receive 410 the data for synchronisation 420 purposes. The purpose of the synchronisation stage is to identify data that is associated with the period of time initiated by the user (survey start and expected completion time). The identified data may then be isolated or extracted 430 for processing purposes (eg. for preparing a survey report).

In embodiments described above where the measurement cycle can be triggered by testing for the current state of the survey instrument when down hole, the timers associated with the survey instrument and the controller still remain synchronized with one another. When a survey report is required, the operator records the time during the survey period when it is considered (by the operator/user at the surface) that the survey instrument is stationary at the desired location down hole. The controller at the surface then seeks to capture or record the time so as to be able to identify and/or isolate the relevant measured survey data once synchronised with the survey instrument when it is back at the surface.

The controller 330 may be arranged so as to provide and display a further timer to the operator indicating the estimated elapsed time as the measurement cycle progresses. For example, the controller 330 may be configured to display a timer to the operator/user showing an appropriate wait time (eg. being in the order of about 2 minutes) per measurement cycle.

All data acquired by the on-board gyroscope sensor is recorded to an appropriate memory module and may include relevant information which corresponds to the time each set of gyroscope data was taken (ie. all data recorded by the gyroscope should be appropriately time stamped).

Thus, in effect, the two complete and consecutive measurements following the time at which the survey was requested 400 are extracted 430 and used to compute the survey results 440. The results can then be processed and used 450 to determine the appropriate calculation for the first index position 350, followed by the second index position 360, or vice versa.

In some environments, efficient use of the time available for measuring purposes can be advantageous. For embodiments where the survey instrument is configured to test for the current state of the survey instrument (eg. a non-stationary state), the measurement cycle may be arranged to commence once the time duration of the monitoring period expires. Thus, in these arrangements, the time needed for the survey instrument to remain stationary for measuring is the time duration of the monitoring period plus the normal time duration of the measurement cycle.

To seek to reduce any undue delay, the survey instrument could be configured so as to measure data during the monitoring period at the same time the instrument is testing, for example, to determine whether the instrument is in a stationary state. The survey instrument could therefore be configured so as to continuously record signals received from any measuring sensor during the monitoring period. Thus, the signals from the sensor(s) may be continuously recorded into a buffer module during the monitoring period. The buffer module may have a prescribed size so as to have sufficient capacity for retaining measured data recorded during the monitoring period.

When the monitoring period expires, and the survey instrument is affirmed, for example, as being in a stationary state (as described above), then the measured data recorded to the buffer module may be used in the preparation of the survey report. In this manner, the measured data recorded during the monitoring period becomes part of the data used for preparing the survey report. Use of the data measured and recorded during the monitoring period therefore serves to reduce the time needed for the survey instrument to remain stationary for measuring purposes.

In one arrangement, the survey instrument could continuously store the current sensor signals into the buffer module having a given size (eg. having a capacity of about 10 seconds of data). When a stationary period of 10 seconds occurs, then the data in the buffer forms a valid portion of the survey measurement. Thus, the measurement time in the initial index position will not have to be extended by the time of the monitoring detection period (eg. 10 seconds).

Processing of the raw measured data can require the need for calibration. For the case where the sensor comprises a gyroscope, the raw measured data can be corrected using a calibration file that can be stored or associated with the survey instrument. The calibration file could also be stored or associated with the controller 330 on the surface 320. In some embodiments, the calibration file can be stored or associated with a handheld unit when serving as the controller 330.

Where an accelerometer is included, for example, the accelerometer data can be corrected using the calibration file. In some arrangements, error terms in the gyroscope data may need to be corrected using the accelerometer data. With the corrected sensor signals, the static bias can be estimated/determined. For configurations where there is provided substantially 180 degrees of rotation between the two indexing positions, it can be assumed that the corrected gyroscope signals have the substantially same magnitude but opposing signs. By way of a brief simple example, a simplified equation might look like this:

$$\text{Gyroscope data in index position 1: } wx1 = +wx + \text{Bias}$$

$$\text{Gyroscope data in index position 2: } wx2 = -wx + \text{Bias}$$

$$\text{Bias} = (wx1 + wx2)/2$$

For situations where the bias is known, the azimuth can be derived from either one of the index positions.

It will be appreciated that the recording of the data down-hole would be stored on a memory module of any suitable configuration provided with the survey instrument. Thus, in one form, the input 410 of the recorded data into the controller 330 and synchronisation 420 with the controller data could comprise a transfer from the memory module to a memory module within the controller 330. The skilled reader would appreciate that any data synchronisation (and associated hardware) solution could be used.

To assist the operator while the survey is being made, the controller 330 would use knowledge (generated via processing of relevant data and/or information under control of the electronic program instructions) of the synchronised events occurring in the survey instrument when down-hole to advise the operator once two complete consecutive measurements had been acquired and the survey was therefore complete.

Because the operator could request a survey at any arbitrary time, and this could potentially occur part way through a measurement, a short delay of up to one acquisition period may be required for the in-process measurement to complete and the survey to properly commence.

Where the terms "system", "device", and "apparatus" are used in the context of the invention, they are to be understood as including reference to any group of functionally related or interacting, interrelated, interdependent or associated components or elements that may be located in proximity to, separate from, integrated with, or discrete from, each other.

Where the words "store", "hold" and "save" or similar words are used in the context of the present invention, they are to be understood as including reference to the retaining or holding of data or information both permanently and/or temporarily in the storage means, device or medium for later retrieval, and momentarily or instantaneously, for example as part of a processing operation being performed.

Furthermore, in embodiments of the invention, the word "determining" is understood to include receiving or accessing the relevant data or information.

Throughout this specification, and the claims which follow, unless the context requires otherwise, the word "comprise" or variations such as "comprises" or "comprising", will be understood to imply the inclusion of a stated integer or group of integers but not the exclusion of any other integer or group of integers.

Furthermore, throughout the specification, and the claims which follow, unless the context requires otherwise, the word "include" or variations such as "includes" or "including", will be understood to imply the inclusion of a stated integer or group of integers but not the exclusion of any other integer or group of integers.

Modifications and variations such as would be apparent to a skilled addressee are deemed to be within the scope of the present invention.

The invention claimed is:

1. An apparatus operable for use with a borehole survey instrument for indexing a device carrying one or more sensors about an indexing axis, the apparatus comprising:

an indexing drive mechanism comprising a drive portion configured in driving engagement with a driven member for indexing the device about the indexing axis, the indexing mechanism being configured for indexing of the device between first and second index positions about the indexing axis, the first and second index positions configured so as to allow a scope of travel therebetween of about 180 degrees, the driven member arranged to surround a portion of a body of the device, the driven member and the body of the device being aligned concentric with the indexing axis, the driven member and the device configured so as to be capable of rotation relative one another about the indexing axis, the driven member arranged in operable association with an assembly comprising at least one resilient element arranged so as to be capable of transitioning to/from a state of bias such that exposure of the device to any undesirable physical forces is reduced to at least some extent.

2. An apparatus according to claim 1, wherein said assembly is configured so as to resiliently associate the driven member with a support, the support arranged so as to be fixed or restrained from movement relative to the indexing axis.

3. An apparatus according to claim 2, wherein the support is of tubular form and arranged so as to surround a second portion of the body of the device adjacent to the driven member, the support and the second portion of the device aligned concentric with the indexing axis.

4. An apparatus according to claim 3, wherein said assembly comprises first and second resilient coupling elements configured so as to resiliently couple the driven member with the support, the first and second resilient coupling elements arranged in a symmetrical manner about and relative to the indexing axis so as to provide an arrangement in which both resilient coupling elements cooperate to, at least in part, dampen or reduce any vibrational and/or shock forces which might be imparted to the device during operation.

5. An apparatus according to claim 4, wherein the first and second resilient coupling elements comprise opposite free ends, one free end of each of the first and second resilient coupling elements attached to the driven member adjacent each other, and the alternate free end of each of the first and second resilient coupling elements attached to the support adjacent each other, the points of attachment provided with the driven member substantially opposing the points of attachment provided with the support relative to the indexing axis.

6. An apparatus according to claim 5, wherein the first and second resilient coupling elements are arranged having substantially equivalent tension so that their respective coupling or biasing forces existing between the driven member and the support are substantially equal when the device is at a position intermediate the first and second index positions.

7. An apparatus according to claim 4, wherein the driven member is operable with the first and second resilient coupling elements such that driving of the driven member beyond one of the first or second index positions causes the device to be biased to or toward the intended index position when driving of the driven member is ceased.

8. An apparatus according to claim 1, wherein the apparatus comprises a limit means configured so as to confirm the device in the first or second index positions when indexed thereto.

9. An apparatus according to claim 8, wherein the limit means comprises a stop member fixed relative to the device and projecting radially away therefrom, the limit means configured so that rotation of the device allows the stop member to be brought to bear against a first region of the support to confirm registration of the device in the first index position when indexed thereto, and against a second region of the support to confirm registration of the device in the second index position when indexed thereto.

10. An apparatus according to claim 9, wherein the first and second regions of the support are provided in the form of opposing regions of a circumferentially aligned slot provided with the support.

11. An apparatus according to claim 1, wherein the or each sensor comprises any of the following: accelerometers, gyroscopes, physical switches, magnetometers, vibration sensors, inclinometers, inductive RPM sensors.

12. An apparatus according to claim 1, wherein the device is configured so as to carry the indexing drive mechanism.

13. An apparatus according to claim 12, wherein the drive portion comprises a drive element configured for mounting with the device eccentrically relative to the indexing axis.

14. An apparatus according to claim 1, wherein transfer of drive to the driven member is by way of a ring gear assembly having an annular ring gear associated with the driven member and operable with a pinion gear associated with the indexing drive mechanism.

15. A down hole surveying instrument comprising an apparatus arranged in accordance with claim 1.

16. A method for operating an apparatus arranged for indexing a device about an indexing axis for use in a down hole surveying operation, the method comprising:

providing an apparatus arranged in accordance with claim 1;

associating the apparatus with a down hole survey instrument so that the apparatus is operable therewith;

causing the apparatus to drive the device about the indexing axis to, toward, or from an index position.

17. A method according to claim 16, wherein the method comprises causing the apparatus to hold the device at an index position for a predetermined period of time before driving the device toward another index position so as to be held there-at for about the predetermined period of time.

18. A method according to claim 16, wherein the method comprises causing the apparatus to reduce the speed of driving the device about the indexing axis as the device approaches an intended index position.

19. A method according to claim 16, wherein the method further comprises:

causing the apparatus to continue to drive the device in the direction of an intended index position once said intended index position has been reached; and causing the apparatus to cease driving of the device such that the device is biased to, toward or at the intended index position.

20. A method according to claim 16, wherein the method comprises driving the device between a first index position and a second index position in a consecutive manner during the course of a predetermined period of time.

21. A method according to claim 16, wherein the method comprises causing the apparatus to drive the device to a park or inactive position, the apparatus configured in a manner in which exposure of the device to any undesirable physical forces when the device is in said park or inactive position is substantially reduced.

* * * * *